US008778581B2

(12) United States Patent
Nonaka et al.

(10) Patent No.: US 8,778,581 B2
(45) Date of Patent: Jul. 15, 2014

(54) TONER

(75) Inventors: Katsuyuki Nonaka, Mishima (JP); Yasuhiro Hashimoto, Mishima (JP); Naoya Isono, Suntou-gun (JP); Akira Sugiyama, Yokohama (JP); Yuhei Terui, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 13/578,813

(22) PCT Filed: May 12, 2011

(86) PCT No.: PCT/JP2011/061469

§ 371 (c)(1),
(2), (4) Date: Aug. 13, 2012

(87) PCT Pub. No.: WO2011/142482

PCT Pub. Date: Nov. 17, 2011

(65) Prior Publication Data

US 2012/0315574 A1 Dec. 13, 2012

(30) Foreign Application Priority Data

May 12, 2010 (JP) ..... 2010-110294

(51) Int. Cl.
*G03G 9/097* (2006.01)
*G03G 9/08* (2006.01)

(52) U.S. Cl.
CPC ..... *G03G 9/09733* (2013.01); *G03G 9/0806* (2013.01)
USPC ..... 430/108.1

(58) Field of Classification Search
CPC ..... G03G 9/0806; G03G 9/09733
USPC ..... 430/108.1
See application file for complete search history.

(56) References Cited

U.S. PATENT DOCUMENTS

| | | | | |
|---|---|---|---|---|
| 5,601,913 | A | 2/1997 | Ohtani et al. | |
| 6,153,346 | A | 11/2000 | Maehata et al. | |
| 6,458,502 | B1 | 10/2002 | Nakamura et al. | |
| 6,569,589 | B2 | 5/2003 | Inaba et al. | |
| 7,014,969 | B2 | 3/2006 | Yachi et al. | |
| 7,112,393 | B2 | 9/2006 | Komoto et al. | |
| 7,459,253 | B2 | 12/2008 | Abe et al. | |
| 7,704,661 | B2 | 4/2010 | Ikeda et al. | |
| 7,811,734 | B2 | 10/2010 | Ogawa et al. | |
| 8,053,156 | B2 | 11/2011 | Abe et al. | |
| 8,211,608 | B2 | 7/2012 | Mizuhata et al. | |
| 8,247,147 | B2 | 8/2012 | Abe et al. | |
| 8,574,805 | B2 | 11/2013 | Terui et al. | |
| 2009/0004589 | A1 | 1/2009 | Yuasa et al. | |
| 2009/0130582 | A1 | 5/2009 | Handa et al. | |
| 2010/0104968 | A1 | 4/2010 | Park et al. | |
| 2011/0053073 | A1 | 3/2011 | Isono et al. | |
| 2011/0097657 | A1* | 4/2011 | Terui et al. | 430/105 |
| 2011/0097660 | A1 | 4/2011 | Sugiyama et al. | |
| 2011/0136054 | A1 | 6/2011 | Watanabe et al. | |
| 2011/0305989 | A1 | 12/2011 | Isono et al. | |
| 2012/0315574 | A1* | 12/2012 | Nonaka et al. | 430/108.4 |

FOREIGN PATENT DOCUMENTS

| | | | |
|---|---|---|---|
| CN | 101336395 | A | 12/2008 |
| CN | 101430513 | A | 5/2009 |
| CN | 101657492 | A | 2/2010 |
| CN | 102597882 | A | 7/2012 |
| JP | 3107062 | B2 | 11/2000 |
| JP | 2002-131977 | A | 5/2002 |
| JP | 2005-300635 | A | 10/2005 |
| JP | 2008-151950 | A | 7/2008 |
| KR | 10-2010-0045921 | A | 5/2010 |
| WO | 2009/139502 | A1 | 11/2009 |

OTHER PUBLICATIONS

PCT International Search Report and Written Opinion of the International Searching Authority, International Application No. PCT/JP2011/061469, Mailing Date Jul. 19, 2011.

Lee, et al., "The Glass Transition Temperatures of Polymers", Polymer Handbook, Second Edition, John Wiley & Sons, 1975, pp. III-139 to III-192.

Chinese Office Action dated Dec. 13, 2013 in Chinese Application No. 201180023695.X.

* cited by examiner

*Primary Examiner* — Peter Vajda

(74) *Attorney, Agent, or Firm* — Fitzpatrick, Cella, Harper and Scinto

(57) ABSTRACT

A toner is provided that exhibits a high long-term image stability even during high-speed printing and that also exhibits an excellent environmental stability. The toner comprises a binder resin, a colorant, and a nonionic surfactant, wherein the nonionic surfactant has an oxyethylene group (EO) and an oxypropylene group (PO) and has a ratio of the number of moles of the oxypropylene group to the number of moles of the oxyethylene group (PO/EO) of at least 0.01 and not more than 5.00; and when A (μg/g) is defined as a nonionic surfactant content on the surface of the toner that can be extracted by methanol from 1 g of the toner and B ($m^2/g$) is defined as a theoretical specific surface area determined from a toner particle diameter distribution obtained by a precision particle diameter distribution analyzer that operates based on an aperture electrical resistance method, a ratio A/B is at least 100 $\mu g/m^2$ and not more than 9000 $\mu g/m^2$.

2 Claims, No Drawings

TONER

TECHNICAL FIELD

The present invention relates to a toner for use in electrophotographic methods, electrostatic recording methods, and magnetic recording methods. More particularly, the present invention relates to a toner for electrostatic image development (hereafter abbreviated as toner), for use in an image recording device that can be used in, for example, copiers, printers, facsimile machines, plotters, and so forth.

BACKGROUND ART

Electrophotographic technology, which is used in, for example, copiers, printers, facsimile machines, and so forth, is continuing to expand and develop. With regard to recent trends, there is increasing demand for the ability to carry out high-speed printing and in another vein there is increasing demand for smaller sizes and better energy savings.

Within the toner sphere, for example, the fixing temperature has been lowered by lowering the glass transition temperature of the resin that is used in the toner particles. In addition, such toner generally is also favorable in terms of image glossiness. However, a toner that has a low glass transition temperature, while exhibiting an excellent low-temperature fixability, is prone to suffer from a reduced long-term storability, environmental stability, or durability, and quite a few means for satisfying the required properties have been proposed to date. For example, a large number of toners having a core-shell structure have been proposed in order to provide a toner that is equipped with both low-temperature fixability and durability and long-term storability. In one example here, both a low-temperature fixability and durability are achieved by lowering the glass transition temperature of the resin used in the core and coating the surface with a resin that has a high glass transition temperature.

However, it is becoming quite problematic to achieve a toner equipped with both low-temperature fixability and durability and long-term storability, for which the required performance levels are increasing year by year, just by improving the core-shell structure.

In addition, it has in the past been believed in the toner field that the surfactant must be removed to the maximum possible degree because surfactant impairs various properties when it is present in toner. Patent document 1 teaches that less nonionic surfactant is better. On the other hand, there are some documents that focus on nonionic surfactant at the toner surface. For example, Patent document 2 discloses that a toner that has an excellent low-temperature fixability and an excellent environmental stability is obtained by specifying the type of the external additive and the nonionic surfactant at the toner surface, and coverage ratio of them. In addition, Patent document 3 discloses that a toner that exhibits excellent charging characteristics and environmental stability is obtained by specifying the residual surfactant and the divalent metal ion originating from the aggregating agent, which are in the toner.

PATENT DOCUMENT

[Patent Document 1] Japanese Patent Application Laid-open No. 2002-131977

[Patent Document 2] Japanese Patent Application Laid-open No. 2008-151950

[Patent Document 3] Japanese Patent No. 3,107,062

SUMMARY OF THE INVENTION

Technical Problem

The present inventors have carried out investigations focusing in particular on durability. The durability often resides in a trade-off relationship with the low-temperature fixability. For example, when the glass transition temperature of the resin is lowered, this is favorable for fixing due to the fluidization of the resin at lower temperatures, but problems such as contamination of various members are prone to appear because the toner is then readily collapsed or crushed by the heat and pressure that are inevitably produced by rubbing. As a result of investigations by the present inventors into means that would avoid member contamination even when the toner is collapsed or crushed, it was discovered that toner adherence to various members is inhibited when a specific nonionic surfactant is present in a suitable amount at the surface.

In Patent document 2, it is disclosed that toner plasticization can be achieved by the presence of nonionic surfactant, but that during high-speed image output the surfactant desorbs from the toner surface and the desorbed surfactant ends up contaminating members. It is also disclosed that there are problems with stability in a high humidity environment.

On the other hand, With regard to the structure described in Patent document 3, it was found to have problems with achieving a high durability.

The object of the present invention is to provide a toner that solves the problems identified above.

That is, the object of the present invention it to provide a toner that exhibits a high long-term image stability even during high-speed printing. At the same time, the object of the present invention is to provide a toner that has a high environmental stability.

Solution to Problem

As a result of extensive and intensive investigations, the present inventors discovered that the problems identified above could be solved by specifying the content and composition of the nonionic surfactant in the case of toner that has nonionic surfactant at the toner surface.

That is, the toner of the present invention is a toner that comprises a binder resin, a colorant, and a nonionic surfactant, wherein the nonionic surfactant has an oxyethylene group (EO) and an oxypropylene group (PO), and has a ratio of the number of moles of the oxypropylene group to the number of moles of the oxyethylene group (PO/EO) of at least 0.01 but not more than 5.00, and when A (μg/g) is defined as a nonionic surfactant content of the surface of the toner that can be extracted by methanol from 1 g of the toner and B ($m^2$/g) is defined as a theoretical specific surface area determined from a toner particle diameter distribution obtained by a precision particle diameter distribution analyzer that operates based on an aperture electrical resistance method, a ratio A/B is at least 100 μg/$m^2$ but not more than 9000 μg/$m^2$.

Advantageous Effects of the Invention

The present invention can provide a toner that exhibits an excellent long-term image stability, even during high-speed printing, and that also has an excellent environmental stability.

DESCRIPTION OF THE EMBODIMENTS

The toner of the present invention is a toner that comprises at least a binder resin, a colorant, and a nonionic surfactant. In addition, the nonionic surfactant present in the toner of the present invention has at least an oxyethylene group and an oxypropylene group, and has a ratio of the number of moles of the oxypropylene group to the number of moles of the oxyethylene group of at least 0.01 and not more than 5.00.

This concept of the nonionic surfactant having at least an oxyethylene group and an oxypropylene group encompasses the following nonionic surfactants: (1) the case wherein an oxyethylene group and an oxypropylene group are present in a single molecule of one nonionic surfactant; and (2) the case wherein the nonionic surfactant contains at least two types of nonionic surfactants and the respective nonionic surfactant molecules have different proportions for the oxyethylene group and oxypropylene group. An example is a mixture of a nonionic surfactant that contains the oxyethylene group but not the oxypropylene group with a nonionic surfactant that contains the oxypropylene group, whereby the mixture as a whole (the nonionic surfactant) contains the oxyethylene group and oxypropylene group.

The oxyethylene group (EO group) referenced by the present invention is the structure represented by a following formula (1) and the oxypropylene group (PO group) is the structure represented by a following formula (2).

[Chemical formula 1]

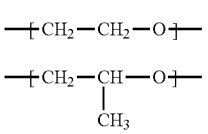

formula (1)

formula (2)

The roles of the oxyethylene group and oxypropylene group will be considered first. Results were obtained that suggested that the oxyethylene group in the nonionic surfactant has a very large inhibiting effect on toner adherence to a member. However, due to its hydrophilicity, hygroscopicity is prone to occur in high humidity environments. This indicates a substantial problem with charging stability in the particular environment. In the past, the oxyethylene group was held to have a negative influence on electrophotographic properties based on the hygroscopicity in a high humidity environment and was excluded as much as possible, therefore, it was received little attention. With regard, on the other hand, to the oxypropylene group in the nonionic surfactant, results were obtained pursuant to the present application that it also exercises an inhibiting effect on adherence to a member through its presence at the toner surface, but this was not an inhibitory effect at the level of the oxyethylene group. However, because the oxypropylene group has more carbons than the oxyethylene group, it has a lower hygroscopicity in a high humidity environment than that of the oxyethylene group. The presence of the oxypropylene group is considered to have the effect mainly of inhibiting the decline in the charging level that is due to the hygroscopicity exercised by the oxyethylene group in a high humidity environment. That is, the effect from the oxyethylene group and oxypropylene group present in the above-specified ratio is thought to be one reason for the appearance in the present invention of the high durability that occurs due to the inhibition of toner adherence to members, and for the appearance in the present invention of a stable charging level in high humidity environments.

An example of the inhibition of toner adherence to members will be considered. Consider, for example, an image-forming apparatus that has a toner carrying member and a control member for controlling the amount of toner carried on the toner carrying member. In this case, the toner control member is pressed under particular conditions against the toner carrying member, and triboelectric charging is produced by the toner passing therethrough and the amount of toner is controlled into a desired range. Accordingly, this control member produces a mechanical force that may deform the toner by friction and pressure and a thermal force that causes softening of the toner by the heated generated by friction. Due to this, a toner adapted for low-temperature fixing will readily yield to these forces and as a result will readily adhere to the toner carrying member and the control member and will be prone to generate problems such as impairing toner coating on the toner carrying member. Based on the effects provided by the present invention, the oxyethylene group and the oxypropylene group present in the nonionic surfactant are considered to function as a lubricant present at the interface between the toner and these members and to thereby inhibit adherence by the toner.

In view of the functions discovered in the present invention for the oxyethylene group and oxypropylene group, their ratio was then considered to be crucial for the realization of an excellent inhibitory effect on adherence to members in good balance with charging stability in a high humidity environment. As a result of investigations in which each of their proportions was varied, it was discovered that at least 0.01 but not more than 5.00 for [PO/EO], i.e., the number of moles of the oxypropylene group versus the number of moles of the oxyethylene group, is the region that can accomplish the object of the present invention. When [PO/EO] in the nonionic surfactant is less than 0.01, a decline in the quantity of charging in a humid environment will readily occur, and as a consequence some means must be devised to prevent this. Moreover, as the printing speed was raised, a phenomenon was seen in which the nonionic surfactant itself tended to desorb from the toner. As a result, for example, in the case of a procedure in which the latent image bearing member is charged by contacting a charging roller with the latent image bearing member, a phenomenon is produced in which the nonionic surfactant adheres to the charging roller. When the [PO/EO] is less than 0.01, the hydrophilicity of the nonionic surfactant as a whole undergoes strengthening, on the other hand, and the hygroscopicity can then be readily presumed to undergo an increase. In addition, it will generally be difficult to contemplate the possibility of a substantial improvement in the hygroscopicity when the oxypropylene group is present at about 0.01-fold with respect to the oxyethylene group. However, the charging characteristics in a high humidity environment are stable at the 0.01-fold boundary as indicated for the present invention. The present inventors believe the reason for the appearance of this phenomenon is as follows. The oxypropylene group, because it has a branched carbon, is conjectured to have much weaker charge leakage characteristics than the oxyethylene group. In a complex mechanism in which the charge produced by triboelectric charging is retransferred to outside the toner, the presence of the specified proportion of the oxypropylene group results in a suitable inhibition of charge leakage, and is presumed to inhibit a decline in the quantity of charging in a high humidity environment.

The facile desorption of the nonionic surfactant from the toner at a [PO/EO] less than 0.01 when the printing velocity was ramped up will now be considered. First, the toner particles are a resin and are generally a resin that is not substantially wetted by water and that may be considered as approximately hydrophobic. Accordingly, the hydrophobic group side of the nonionic surfactant is thought to strongly bind to the toner particle, and this has also been suggested experimentally. The oxyethylene group in the nonionic surfactant is the moiety that behaves like a hydrophilic group, it is because that the oxyethylene group has only a hydrophilicity that is weaker than the ionic group in an ionic surfactant, and the hydrophilic behavior is due to the presence of multiple connected ethylene oxide groups. Thus, it is the oxyethylene ensemble, i.e., a polyoxyethylene, that exhibits hydrophilicity. With regard to structure, the oxyethylene group has two carbons, and therefore, at least the region of these carbons is hydrophobic. Thus, a compatibility with the resin is present and a binding force with the resin is therefore also intrinsically present.

Taking the preceding into account, when a nonionic surfactant is present at the toner surface and the toner is surrounded by air, it is inferred that a hydrophilic group that has an oxyethylene group or oxypropylene group will bind to the toner surface with a force of a certain strength, although not that for a hydrophobic group. The inventors hypothesize that, on the whole, both the hydrophilic group and hydrophobic group of the nonionic surfactant used by the present invention probably bind to the toner particle, although many points remain unknown, e.g., what change occurs due to the humidity in the air, what is the state of attachment when moisture has been adsorbed, and so forth. Since the oxypropylene group exhibits a stronger hydrophobicity than the oxyethylene group, the binding force with the toner exhibits an increasing trend, and this is thought to be approximately correct in its conception. Thus, the presence of the oxypropylene group in at least the prescribed proportion is thought to make desorption from the toner more difficult, and it is this effect that is believed to be manifested by the present invention. When this [PO/EO] is larger than 5.00, the inhibitory effect on toner adherence to members is substantially weakened and the object of the invention of obtaining a high durability becomes increasingly remote. As previously described, the present inventors consider the oxyethylene group to have a higher lubricating activity than the oxypropylene group, and, when the oxyethylene group proportion is too small, the ability to inhibit toner adherence to a member is believed to be substantially impaired.

A [PO/EO] of at least 0.02 but not more than 3.00 is a more preferred condition in the present invention, while a [PO/EO] of at least 0.04 but not more than 1.00 is even more preferred. The effects of the present invention are further enhanced in this range.

The nonionic surfactant quantity per toner unit surface area to favorably realize the previously indicated effects will now be considered. This condition can be determined from the nonionic surfactant content of the toner surface that can be extracted from the toner by methanol and the theoretical specific surface area determined from the toner particle diameter distribution provided by a precision particle diameter distribution analyzer that operates on an aperture electrical resistance method. In specific terms, the ratio of A to B (A/B) is at least 100 $\mu g/m^2$ but not more than 9000 $\mu g/m^2$ where A ($\mu g/g$) is defined as the nonionic surfactant content of the toner surface that can be extracted by methanol from 1 g of the toner and B ($m^2/g$) is the theoretical specific surface area determined from the toner particle diameter distribution provided by a precision particle diameter distribution analyzer that operates on an aperture electrical resistance method. This approximates the quantity of surfactant present at the toner surface and expresses the surfactant quantity required for the present invention. The high durability and high environmental stability that are objects of the present invention can be obtained at an (A/B) in the indicated range. In order to analyze the nonionic surfactant quantity at the toner surface, extraction was performed with strongly hydrophilic methanol, which undergoes almost no permeation into the toner interior and causes almost no swelling of the toner, which is mainly composed of a resin.

The conditions for extraction will be described late in detail.

An (A/B) of at least 100 $\mu g/m^2$ is the lower limit condition for obtaining the inhibitory effect on toner adherence to members that is sought by the present invention. The lubricating effect originating with the nonionic surfactant is weakened when (A/B) is less than 100 $\mu g/m^2$. On the other hand, when (A/B) exceeds 9000 $\mu g/m^2$, the large amount of nonionic surfactant per toner unit surface area results in facile desorption of the nonionic surfactant from the toner, even when the other conditions of the present invention are satisfied. In addition, this large nonionic surfactant quantity is also a range in which an absorbed moisture-induced decline in the quantity of charging is prone to occur in a high humidity environment. In addition, the presence of the nonionic surfactant at the toner surface in excess of an optimal quantity also creates the possibility of a nonionic surfactant-mediated aggregation of toner particles during storage. Thus, an (A/B) of not more than 9000 $\mu g/m^2$ is the upper limit condition for making it possible to obtain environmental stability for charging, which is sought by the present invention, in combination with an inhibitory effect on toner adherence to members, which is also sought by the present invention. A more preferred condition for the present invention is an (A/B) of at least 300 $\mu g/m^2$ but not more than 6000 $\mu g/m^2$ and an even more favorable condition is an A/B of at least 500 $\mu g/m^2$ but not more than 3000 $\mu g/m^2$. The effects sought by the present invention, i.e., environmental stability for charging and an inhibitory effect on toner adherence to members, are more favorably manifested in this range.

The nonionic surfactant used by the present invention favorably contains at least one selected from the group consisting of polyoxyalkylene alkyl ethers, polyoxyalkylene alkyl esters, and polyethylene glycol-polypropylene glycol block copolymers. The nonionic surfactant used by the present invention more preferably contains at least a polyoxyalkylene alkyl ether or a polyoxyalkylene alkyl ester.

The polyethylene glycol-polypropylene glycol block copolymer is a so-called Pluronic-type nonionic surfactant.

More specifically, compounds with the following formula (3) or formula (4) are preferred. The nonionic surfactant used by the present invention more preferably contains at least a polyoxyalkylene alkyl ether. The use of the preceding provides an even greater inhibition of the generation of excess toner charging in cases corresponding to high-speed printing in a low humidity environment.

[Chemical formula 2]

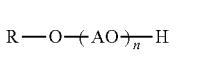

formula (3)

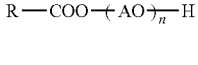

formula (4)

R: alkyl group having 1 to 30 carbon(s)
AO: oxyalkylene
n: average addition mole number The average addition mole number of oxyalkylene in the polyoxyalkylene chain indicated above is preferably at least 5 but not more than 50, more preferably at least 5 but not more than 20, even more preferably at least 5 but not more than 15, and particularly preferably at least 8 but not more than 12. The R above is preferably an alkyl group having 5 to 25 carbons and more preferably is an alkyl group having 8 to 16 carbons.

A common feature among the aforementioned polyoxyalkylene alkyl ethers, polyoxyalkylene alkyl esters, and polyethylene glycol-polypropylene glycol block copolymers is that they are aliphatic. When this was investigated, there was a tendency for the difference in charging level between a low humidity environment and a high humidity environment to be smaller for a toner having nonionic surfactant that was just aliphatic than for a toner having an aromatic nonionic surfactant. Considering this from the viewpoint of chemical structure, it is presumed that the aromatic, which has an aromatic ring, more readily engages in electron retention and more readily becomes an electron source than the aliphatic, and this is thought to be connected also to facilitated triboelectric charging. While the specific reasons are unknown, among the preceding, a toner that contains nonionic surfactant that has a polyoxyalkylene alkyl ether exhibits little difference in charging level among different environments and is therefore most preferred. There are following two cases for bringing the ratio of the number of moles of the oxypropylene group to the number of moles of the oxyethylene group to at least 0.01 but not more than 5.00 in the nonionic surfactant that is used, and either case may be employed. In one case, the oxyethylene group and oxypropylene group are present in a single molecule, and their proportion is in the desired range. This can be produced mainly by modifying the method of synthesizing the polyoxyalkylene. In the other case, the proportions of the oxyethylene group and oxypropylene group are different in respective molecules, and the average for the whole provides the desired range. For example, a polyoxyethylene alkyl ether not having the oxypropylene group may be mixed with a polyoxyalkylene alkyl ether having the oxypropylene group, and the desired proportions may be achieved in this mixture as a whole. The predicted mechanism for the effects described above for the present invention are manifested by the nonionic surfactant molecular population as a whole, and the effects are obtained by either of these approaches.

The toner of the present invention realizes its effects by comprising the nonionic surfactant at the toner particle surface. The method for placing the nonionic surfactant at the surface of the toner can be exemplified by a method in which the nonionic surfactant is added and attached to a toner particle dispersion, and a method in which the nonionic surfactant is dispersed in a highly volatile solvent such as methanol, followed by atomization and mixing with a spray. However, the nonionic surfactant is preferably present as uniformly as possible at the toner surface. For this purpose, it is preferred to disperse and attach the toner particles in a solution of the nonionic surfactant such as water or an aqueous methanol solution. When the toner has been obtained by a kneading pulverization method or by another dry method, the procedure such as a step of dispersing in a nonionic surfactant solution, a washing step of removing excess surfactant, and a filtration step and drying step is complex. Therefore, the toner particles are preferably obtained by a production method in which granulation is performed in an aqueous medium, such as suspension polymerization methods, emulsion polymerization methods, and suspension granulation methods.

The timing of the addition of the nonionic surfactant is preferably post-toner particle granulation, and better properties were provided by post-toner particle granulation. Since advantageous effects are manifested by the presence of the nonionic surfactant at the toner particle surface, the nonionic surfactant is preferably added post-toner particle granulation.

As the solid-liquid separation technique for the toner particles, any already known technique may be used, e.g., filtration, centrifugal separation, decantation, and so forth. With regard to the washing technique, while any method may be used, a preferred technique is to use a vacuum belt filter and to wash the obtained toner particle cake. The use of this method makes it possible to easily control the nonionic surfactant content of the toner particle surface. In addition, this method makes possible a simple and convenient control of the nonionic surfactant content of the toner surface by obtaining the toner particle cake without using nonionic surfactant, and then washing it with a nonionic surfactant solution having a desired concentration or a nonionic surfactant dispersion having a desired concentration.

Toner production methods will now be described, but there is no limitation whatever to the following. The toner particles used in the present invention may be produced using any method, but, as noted above, the toner particles are preferably obtained by a production method in which granulation is performed in an aqueous medium, e.g., a suspension polymerization method, emulsion polymerization method, or suspension granulation method. An example of the suspension polymerization method, which is the most favorable method for obtaining the toner particles used by the present invention, is provided below, but there is no limitation to this.

A polymerizable monomer composition is prepared as follows: the polymerizable monomer constituting the binder resin, a colorant, and other optional additives are dissolved or dispersed to uniformity using a disperser such as a homogenizer, ball mill, colloid mill, or ultrasound disperser, and a polymerization initiator is dissolved therein to give the polymerizable monomer composition. This polymerizable monomer composition is then suspended and granulated in an aqueous medium that contains a dispersion stabilizer and the polymerizable monomer is polymerized to produce toner particles. The polymerization initiator may be added at the same time as the addition of the other additives to the polymerizable monomer or may be mixed in just before suspension in the aqueous medium. In addition, the polymerization initiator dissolved in the polymerizable monomer or in a solvent may also be added just after granulation and prior to the initiation of the polymerization reaction.

The binder resin for the toner can be exemplified by the styrene-acrylic copolymers, styrene-methacrylic copolymers, epoxy resins, and styrene-butadiene copolymer that are generally used. A radically polymerizable vinylic polymerizable monomer can be used as the polymerizable monomer for forming the binder resin. A monofunctional polymerizable monomer or a polyfunctional polymerizable monomer can be used as this vinylic polymerizable monomer.

The polymerizable monomer can be exemplified by the following: styrene; styrene monomers such as o-(m-, p-)methylstyrene and m-(p-)ethylstyrene; acrylate ester monomers and methacrylate ester monomers such as methyl acrylate, methyl methacrylate, ethyl acrylate, ethyl methacrylate, propyl acrylate, propyl methacrylate, butyl acrylate, butyl methacrylate, octyl acrylate, octylmethacrylate, dodecyl acrylate, dodecyl methacrylate, stearyl acrylate, stearyl methacrylate, behenyl acrylate, behenyl methacrylate, 2-ethylhexyl acrylate, 2-ethylhexyl methacrylate, dimethylaminoethyl acrylate, dimethylaminoethyl methacrylate, diethylaminoethyl acrylate, and diethylaminoethyl methacrylate; and ene monomers such as butadiene, isoprene, cyclohexene, acrylonitrile, methacrylonitrile, amide acrylate, and amide methacrylate.

A single one of these polymerizable monomers may be used, or a suitably selected mixture of polymerizable monomers may be used whereby the theoretical glass transition temperature (Tg) described in the publication Polymer Handbook, Second Edition, III-pp. 139-192 (John Wiley & Sons) is generally from 40 to 75° C. In order to achieve low-temperature fixing, there has been a trend in recent years of establishing a low glass transition temperature of not more than approximately 60° C., insofar as the other quality circumstances permit. When the theoretical glass transition temperature is less than 40° C., problems are prone to appear from the standpoint of the storage stability of the toner and the consistency of the durability of the toner, while the fixing performance progressively declines when 75° C. is exceeded.

A low molecular weight polymer may also be added during toner particle production in order to provide a preferred molecular weight distribution for the toner and achieve compatibility between the low-temperature fixability and the developing performance. When the toner particles are produced by a suspension polymerization method, the low molecular weight polymer can be added to the polymerizable monomer composition.

A low molecular weight polymer with a weight-average molecular weight (Mw) as measured by gel permeation chromatography (GPC) in the range from 2,000 to 5,000 and an Mw/Mn less than 4.5 and preferably less than 3.0 is preferred in terms of the fixing performance and developing performance.

The low molecular weight polymer can be exemplified by low molecular weight polystyrene, low molecular weight styrene-acrylate ester copolymers, and low molecular weight styrene-acrylic copolymers.

A carboxyl group-containing polar resin such as a polyester resin and a polycarbonate resin is preferably also used in combination with the binder resin. For example, in the case of the direct production of toner particles by the suspension polymerization method, when the polar resin is added when entering into the polymerization step from the dispersion step, a thin layer of the added polar resin can be formed on the toner particle surface in conformity to the balance between the polarities presented by the aqueous dispersion medium and the polymerizable monomer composition that forms the toner particles. That is, a toner can be produced that has a core-shell structure that has the polar resin for the surface layer.

The preferred quantity of addition for the polar resin is 1 to 25 mass parts per 100 mass parts of the binder resin. The polar resin can be exemplified by polyester resins, epoxy resins, styrene-acrylic acid copolymers, styrene-methacrylic acid copolymers, and styrene-maleic acid copolymers. Polyester resins are particularly preferred, and an acid value in the range from 4 to 20 mg KOH/g is preferred. In addition, the molecular weight preferably has a main peak molecular weight from 3,000 to 30,000 because this makes it possible to provide an excellent toner particle fluidity and excellent negative triboelectric charging characteristics.

A cross-linking agent may also be used during binder resin synthesis in order to control the molecular weight of the toner while raising the mechanical strength of the toner particles.

The difunctional cross-linking agents can be exemplified by divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, the respective diacrylates of polyethylene glycol #200, #400, and #600, dipropylene glycol diacrylate, polypropylene glycol diacrylate, polyester-type diacrylates (MANDA, Nippon Kayaku Co., Ltd), and the preceding in which dimethacrylate is substituted for diacrylate. The polyfunctional cross-linking agents can be exemplified by pentaerythritol triacrylate, trimethylolethane triacrylate, trimethylolpropane triacrylate, tetramethylolmethane tetraacrylate, oligoester acrylate and its methacrylate, 2,2-bis(4-methacryloxypolyethoxyphenyl)propane, diallyl phthalate, triallyl cyanurate, triallyl isocyanurate, and triallyl trimellitate. The quantity of cross-linking agent addition is preferably 0.05 to 10 mass parts and more preferably 0.1 to 5 mass parts, in each case per 100 mass parts of the polymerizable monomer.

The polymerization initiator can be exemplified by azo-type and diazo-type polymerization initiators such as 2,2'-azobis (2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobismethylbutyronitrile; peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and tert-butyl peroxypivalate. The quantity of use for these polymerization initiators will vary as a function of the desired degree of polymerization, but is generally from 3 to 20 mass parts per 100 mass parts of the polymerizable monomer. The type of polymerization initiator will vary somewhat depending on the polymerization method, and a single polymerization initiator or a mixture of polymerization initiators can be used taking into consideration the 10 hour half-life temperature.

The toner of the present invention contains a colorant as an essential component in order to provide tinting strength. Colorants preferred for use in the present invention can be exemplified by the following organic pigments, organic dyes, and inorganic pigments. Organic pigments and organic dyes that are cyan colorants can be exemplified by copper phthalocyanine compounds and their derivatives, anthraquinone compounds, and basic dye lake compounds. The following are specific examples: C.I. Pigment Blue 1, C.I. Pigment Blue 7, C.I. Pigment Blue 15, C.I. Pigment Blue 15:1, C.I. Pigment Blue 15:2, C.I. Pigment Blue 15:3, C.I. Pigment Blue 15:4, C.I. Pigment Blue 60, C.I. Pigment Blue 62, and C.I. Pigment Blue.

Organic pigments and organic dyes that are magenta colorants can be exemplified by condensed azo compounds, diketopyrrolopyrrole compounds, anthraquinones, quinacridone compounds, basic dye lake compounds, naphthol compounds, benzimidazolone compounds, thioindigo compounds, and perylene compounds. The following are specific examples: C.I. Pigment Red 2, C.I. Pigment Red 3, C.I. Pigment Red 5, C.I. Pigment Red 6, C.I. Pigment Red 7, C.I. Pigment Red 19, C.I. Pigment Red 23, C.I. Pigment Red 48:2, C.I. Pigment Red 48:3, C.I. Pigment Red 48:4, C.I. Pigment Red 57:1, C.I. Pigment Red 81:1, C.I. Pigment Red 122, C.I. Pigment Red 144, C.I. Pigment Red 146, C.I. Pigment Red 150, C.I. Pigment Red 166, C.I. Pigment Red 169, C.I. Pigment Red 177, C.I. Pigment Red 184, C.I. Pigment Red 185, C.I. Pigment Red 202, C.I. Pigment Red 206, C.I. Pigment Red 220, C.I. Pigment Red 221, and C.I. Pigment Red 254. Organic pigments and organic dyes that are yellow colorants can be exemplified by compounds as typified by condensed azo compounds, isoindolinone compounds, anthraquinone compounds, azo-metal complexes, methine compounds, and arylamide compounds. The following are specific examples:

C.I. Pigment Yellow 12, C.I. Pigment Yellow 13, C.I. Pigment Yellow 14, C.I. Pigment Yellow 15, C.I. Pigment Yellow 17, C.I. Pigment Yellow 62, C.I. Pigment Yellow 74, C.I. Pigment Yellow 83, C.I. Pigment Yellow 93, C.I. Pigment Yellow 94, C.I. Pigment Yellow 95, C.I. Pigment Yellow 97, C.I. Pigment Yellow 109, C.I. Pigment Yellow 110, C.I. Pigment Yellow 111, C.I. Pigment Yellow 120, C.I. Pigment Yellow 127, C.I. Pigment Yellow 128, C.I. Pigment Yellow 129, C.I. Pigment Yellow 147, C.I. Pigment Yellow 151, C.I. Pigment Yellow 154, C.I. Pigment Yellow 155, C.I. Pigment Yellow 168, C.I. Pigment Yellow 174, C.I. Pigment Yellow 175, C.I. Pigment Yellow 176, C.I. Pigment Yellow 180, C.I. Pigment Yellow 181, C.I. Pigment Yellow 191, and C.I. Pigment Yellow 194. Black colorants can be exemplified by carbon black and black colorants provided by mixing the previously indicated yellow colorants, magenta colorants, and cyan colorants to give black.

A single one of these colorants may be used or a mixture may be used; these colorants may also be used in the form of the solid solution. The colorant used in the present invention is selected with regard to hue angle, chroma, lightness, lightfastness, OHP transparency, and dispersibility in the toner. The colorant is preferably used in an addition of 1 to 20 mass parts per 100 mass parts of the polymerizable monomer or binder resin. When the toner particles are obtained by a polymerization method, precautions must be taken with regard to the ability of the colorant to inhibit the polymerization and the ability of the colorant to migrate into the aqueous phase, and the colorant is preferably subjected in advance to a hydrophobic treatment using a substance that lacks the ability to inhibit polymerization. In particular, dye-based colorants and carbon blacks frequently have the ability to inhibit polymerization and precautions must therefore be taken with their use. In an example of a preferred method for treating a dye-based colorant, the polymerizable monomer is polymerized in advance in the presence of the dye and the obtained colored polymer is then added to the polymerizable monomer composition. In addition, with carbon black, in addition to the same treatment as described above for dyes, a treatment may be carried out using a substance (e.g., a polyorganosiloxane) that reacts with the surface functional groups on the carbon black.

In order to obtain a good quality fixed image, the toner of the present invention preferably contains from 0.5 to 50 mass parts wax per 100 mass parts of the binder resin. 5.0 to 30 mass parts is more preferred and 6.5 to 20 mass parts is even more preferred. Waxes usable in the toner can be exemplified by petroleum waxes and their derivatives such as paraffin waxes, microcrystalline waxes, and petrolatum; montan wax and its derivatives; hydrocarbon waxes produced by the Fischer-Tropsch method and derivatives thereof; polyolefin waxes as typified by polyethylene, and derivatives thereof; and natural waxes such as carnauba wax and candelilla wax, and derivatives thereof. The derivatives encompass oxidation products, block copolymers with vinylic monomers, and graft modifications. Other examples are higher aliphatic alcohols; fatty acids such as stearic acid and palmitic acid and compounds thereof; acid amide waxes; ester waxes; ketones; hydrogenated castor oil and derivatives thereof; vegetable waxes; animal waxes; and so forth. Among the preceding waxes, waxes having a peak temperature for the highest endothermic peak as measured with a differential scanning calorimetry (DSC) of 40° C. to 110° C. are preferred, while 45° C. to 90° C. is more preferred. More preferred are paraffin waxes and Fischer-Tropsch waxes that have a highest endothermic peak temperature as measured by DSC of 70° C. to 85° C. Known inorganic and organic dispersion stabilizers can be used as the dispersion stabilizer employed in the production of the previously described aqueous medium. Specific examples of inorganic dispersion stabilizers are tri calcium phosphate, magnesium phosphate, aluminum phosphate, zinc phosphate, magnesium carbonate, calcium carbonate, calcium hydroxide, magnesium hydroxide, aluminum hydroxide, calcium meta-silicate, calcium sulfate, barium sulfate, bentonite, silica, and alumina. Specific examples of organic dispersants are polyvinyl alcohol, gelatin, methyl cellulose, methylhydroxypropyl cellulose, ethyl cellulose, sodium salt of carboxymethyl cellulose, and starch.

A nonionic, anionic, or cationic surfactant can also be used as the dispersion stabilizer. However, as previously noted, the nonionic surfactant is more preferably added after the toner particles have been formed.

A poorly water-soluble inorganic dispersion stabilizer is preferred for the dispersion stabilizer that is used in the production of the aqueous medium, and the use of a poorly water-soluble inorganic dispersion stabilizer that is soluble in acid is also preferred. When the aqueous medium is prepared using a poorly water-soluble inorganic dispersion stabilizer, the quantity of use of this dispersion stabilizer is preferably from 0.2 to 2.0 mass parts per 100 mass parts of the polymerizable monomer. In addition, the aqueous medium is preferably prepared in the present invention using from 300 to 3,000 mass parts water per 100 mass parts of the polymerizable monomer composition.

When an aqueous medium is produced in which such a poorly water-soluble inorganic dispersion stabilizer has been dispersed, a commercially available dispersion stabilizer may be directly employed and dispersed as such. In addition, in order to obtain dispersion stabilizer particles that have a fine and uniform granulometry, an aqueous medium may be prepared by producing the poorly water-soluble inorganic dispersion stabilizer under high-speed stirring in a liquid medium such as water. In the case of use of, for example, tricalcium phosphate as the dispersion stabilizer, a preferred dispersion stabilizer can be obtained by mixing an aqueous sodium phosphate solution with an aqueous calcium chloride solution with vigorous stirring to form finely divided tricalcium phosphate particles.

A charge control resin can also be used in the present invention. The use of a polymer or copolymer that has a sulfonic acid group, a sulfonic acid salt group, or a sulfonate ester group is preferred. The sulfonic acid group-containing polymer can be exemplified in particular by high molecular weight compounds comprising a copolymer provided by the polymerization of a sulfonic acid group-containing acrylamide monomer or a sulfonic acid group-containing methacrylamide monomer with styrene and/or an acrylic acid-type monomer and/or a methacrylic acid-type monomer. The use of this can provide preferred charging characteristics without exercising an effect on the thermal characteristics required in the toner particles. The preferred content of the charge control resin is 0.3 to 15 mass parts per 100 mass parts of the binder resin.

In addition to the charge control resin, a charge control agent may also be used in the toner of the present invention. The incorporation of a charge control agent can stabilize the charging characteristics and makes possible control of the optimal triboelectric charge quantity in conformity to the development system. A known charge control agent can be used, wherein a preferred charge control agent can in particular increase the charging speed and can stably maintain a specific or prescribed or constant amount of charge. Moreover, when the toner particles are produced by a direct polymerization method, a particularly preferred charge control agent will have little ability to inhibit polymerization and will be substantially free of material that solubilizes into the aqueous medium. Charge control agents that control the toner to a negative chargeability can be exemplified by organometal compounds and, as chelate compounds, monoazo-metal compounds, acetylacetone-metal compounds, and metal compounds of aromatic oxycarboxylic acids, aromatic dicarboxylic acids, oxycarboxylic acids, and dicarboxylic acids. Also included are aromatic oxycarboxylic acids and aromatic mono- and polycarboxylic acids and their metal salts, anhydrides, and esters and phenol derivatives such as bisphenol. Additional examples are urea derivatives, metal-containing salicylic acid compounds, metal-containing naphthoic acid compounds, boron compounds, quaternary ammonium salts, and calixarene.

Charge control agents that control the toner to a positive chargeability can be exemplified by nigrosine and nigrosine denatured by fatty acid metal salts; guanidine compounds; imidazole compounds; quaternary ammonium salts such as tributylbenzylammonium-1-hydroxy-4-naphthosulfonate salts and tetrabutylammonium tetrafluoroborate; onium salts that are analogues to the preceding, such as the phosphonium salt, and their lake pigments; triphenylmethane dyes and their lake pigments (wherein the laking agent can be exemplified by phosphotungstic acid, phosphomolybdic acid, phosphomolybdic tungstic acid, tannic acid, lauric acid, gallic acid, ferricyanide, and ferrocyanide); the metal salts of higher fatty acids; and resin-based charge control agents.

A single one of these charge control agents can be used or combinations of two or more can be used.

Metal-containing salicylic acid compounds are preferred among the preceding charge control agents wherein the metal therein is particularly preferably aluminum or zirconium. The most preferred charge control agent is the compound aluminum 3,5-di-tert-butylsalicylate. The quantity of charge control agent addition is preferably 0.01 to 20 mass parts per 100 mass parts of the polymerizable monomer or binder resin and is more preferably 0.50 to 10 mass parts per 100 mass parts of the polymerizable monomer or binder resin.

The toner fluidity and chargeability can also be improved in the present invention by the addition to the toner particles of a fine powder as an external additive. Examples of the inorganic fine powder are silica fine powder, titanium oxide fine powder, and their double oxide fine powders. Silica fine powder and titanium oxide fine powder are preferred among the inorganic fine powders. Additional improvements in the regulation of the quantity of toner charging and in the environmental stability can also be achieved by subjecting these inorganic fine powders to a hydrophobic treatment. The treatment agent for hydrophobing the inorganic fine powder can be exemplified by undenatured silicone varnishes, various denatured silicone varnishes, undenatured silicone oils, various denatured silicone oils, silane compounds, silane coupling agents, other organosilicon compounds, and organotitanium compounds. A single treatment agent may be used or a combination of treatment agents may be used. Silicone oil-treated inorganic fine powders are preferred among the preceding. The total quantity of inorganic fine powder is preferably from 1.0 to 5.0 mass parts per 100 mass parts of the toner particles and more preferably is from 1.0 mass part to 2.5 mass parts per 100 mass parts of the toner particles.

The methods of measuring the various properties referenced by the present invention are described below.

<Measurement of the Theoretical Specific Surface Area (B) Determined from the Toner Particle Diameter Distribution and Measurement of the Weight-Average Particle Diameter (D4) of the Toner>

The theoretical specific surface area (B) determined from the toner particle diameter distribution and the weight-average particle diameter (D4) of the toner were calculated as follows. The measurement of the theoretical specific surface area (B) and the measurement of the weight-average particle diameter (D4) had the following steps up to and including (6) in common.

The measurement instrument used is a Coulter Counter Multisizer 3 (registered trademark of Beckman Coulter, Inc.), which is a precision particle diameter distribution analyzer that uses the aperture electrical resistance method and is equipped with a 100 μm aperture tube. The measurement conditions are set and the measurement data is analyzed using the Beckman Coulter Multisizer 3 Version 3.51 software (Beckman Coulter, Inc.) provided with the instrument. The measurements are performed using 25,000 channels for the number of effective measurement channels.

A solution of special grade sodium chloride dissolved in ion-exchanged water and brought to a concentration of approximately 1 mass %, for example, "ISOTON II" from Beckman Coulter, Inc., can be used for the aqueous electrolyte solution used for the measurement. The dedicated software is set as follows prior to running the measurement and analysis. On the "Change Standard Operating Method (SOM)" screen of the dedicated software, the total count number for the control mode is set to 50000 particles, the number of measurements is set to 1, and the value obtained using "10.0 μm standard particles" (Beckman Coulter, Inc.) is set for the Kd value. The threshold value and noise level are automatically set by pressing the "threshold value/noise level button". The current is set to 1600 μA, the gain is set to 2, the electrolyte solution is set to ISOTON II, and "flush aperture tube after measurement" is checked. On the "pulse-to-particle diameter conversion setting" screen of the dedicated software, the bin interval is set to logarithmic particle diameter, the particle diameter bin is set to 256 particle diameter bins, and the particle diameter range is set to from 2 μm to 60 μm.

The specific measurement method is as follows.

(1) Approximately 200 mL of the previously described aqueous electrolyte solution is introduced into the glass 250-mL roundbottom beaker provided for use with the Multisizer 3 and this is then set into the sample stand and counterclockwise stirring is performed with a stirring rod at 24 rotations per second. Dirt and bubbles in the aperture tube are removed using the "aperture flush" function of the dedicated software.

(2) Approximately 30 mL of the previously described aqueous electrolyte solution is introduced into a glass 100-mL flatbottom beaker. To this is added the following as a dispersing agent: approximately 0.3 mL of a dilution prepared by diluting "Contaminon N" approximately 3-fold on a mass basis with ion-exchanged water; "Contaminon N" is a 10 mass % aqueous solution of a neutral pH 7 detergent for cleaning precision measurement instrumentation and comprises a nonionic surfactant, an anionic surfactant, and an organic builder, from Wako Pure Chemical Industries, Ltd.

(3) An "Ultrasonic Dispersion System Tetora 150" ultrasound disperser from Nikkaki Bios Co., Ltd., is prepped; this has an output of 120 Wand is equipped with two oscillators oscillating at 50 kHz and configured with a phase shift of 180°. A prescribed quantity of ion-exchanged water is introduced into the water tank of the ultrasound disperser and approximately 2 mL of the above-referenced Contaminon N is added to the water tank.

(4) The beaker from (2) is placed in the beaker holder of the ultrasound disperser and the ultrasound disperser is activated. The height position of the beaker is adjusted to provide the maximum resonance state for the surface of the aqueous electrolyte solution in the beaker.

(5) While exposing the aqueous electrolyte solution in the beaker of (4) to the ultrasound, approximately 10 mg of the toner is added in small portions to the aqueous electrolyte solution and is dispersed. The ultrasound dispersing treatment is continued for another 60 seconds. During ultrasound dispersion, the water temperature in the water tank is adjusted as appropriate to be at least 10° C. but no more than 40° C.

(6) Using a pipette, the aqueous electrolyte solution from (5) containing dispersed toner is added dropwise into the round-bottom beaker of (1) that is installed in the sample stand and the measurement concentration is adjusted to approximately 5%. The measurement is run until the number of particles measured reaches 50000. At this point, proceed to (7-1) for measurement of the theoretical specific surface area (B) and proceed to (7-2) for the weight-average particle diameter (D4).

(7-1) The measurement data is analyzed using the above-referenced dedicated software provided with the instrument and the theoretical specific surface area is calculated as described below. First, when the dedicated software is set to graph/number %, the results for the 16 channels are then calculated on the "analysis/number statistics (arithmetic average)" screen. Specifically, the measurement results for the particle diameter distribution (number statistical values) for the measured toner sample are partitioned into the 16 channels indicated below and the number % for the particle diameter is calculated for each range.

| number CH | range | DIF % |
|---|---|---|
| 1 | 1.587 to 2.000 μm | $N_1$ |
| 2 | 2.000 to 2.520 μm | $N_2$ |
| 3 | 2.520 to 3.175 μm | $N_3$ |
| 4 | 3.175 to 4.000 μm | $N_4$ |
| 5 | 4.000 to 5.040 μm | $N_5$ |
| 6 | 5.040 to 6.350 μm | $N_6$ |
| 7 | 6.350 to 8.000 μm | $N_7$ |
| 8 | 8.000 to 10.079 μm | $N_8$ |
| 9 | 10.079 to 12.699 μm | $N_9$ |
| 10 | 12.699 to 16.000 μm | $N_{10}$ |
| 11 | 16.000 to 20.159 μm | $N_{11}$ |
| 12 | 20.159 to 25.398 μm | $N_{12}$ |
| 13 | 25.398 to 32.000 μm | $N_{13}$ |
| 14 | 32.000 to 40.317 μm | $N_{14}$ |
| 15 | 40.317 to 50.797 μm | $N_{15}$ |
| 16 | 50.797 to 64.000 μm | $N_{16}$ |

For each particle diameter range, the particles are assumed to be spherical particles with a specific gravity of 1.00 (g/cm$^3$) that all have the particle diameter precisely in the middle of the particular range (for example, the particles in the 1.587 to 2.000 μm range are assumed to all be 1.7935 μm). The theoretical specific surface area (m$^2$/g) of the measured toner is calculated from the surface area per particle for the particles in each range and the number % for the particles in each range. Thus, letting Rn(m) be the radius of the midpoint particle diameter for a particular range and letting Nn (number %) be the number % for this range, when the calculations are performed for all of the indicated ranges, the theoretical specific surface area (B) determined from the toner particle diameter distribution is then calculated as below. theoretical specific surface area (B: m$^2$/g)$=\{\Sigma(4\pi Rn^2\times Nn)\}/[\Sigma\{(4/3)\pi Rn^3\times Nn\times 1.00\times 10^{-6}\}]$ (n=1 to 16)

(7-2) The measurement data is analyzed by the dedicated software provided with the instrument to calculate the weight-average particle diameter (D4) and the number-average particle diameter (D1). When the dedicated software is set to graph/volume %, the "average diameter" on the "analysis/volume statistics (arithmetic average)" screen is the weight-average particle diameter (D4).

<Measurement of the Nonionic Surfactant Content (A: μg/g) of the Toner Surface>

The nonionic surfactant content of the toner surface is determined as follows by $^1$H-NMR (nuclear magnetic resonance) measurement.

First, 5 g of the toner and 50 mL methanol are precisely weighed into a sample bin and thoroughly mixed and then exposed for 5 minutes to ultrasound using a desktop ultrasound cleaner (for example, a "B2510J-MTH" (product name) from Branson) having an output of 125 W and oscillating at 42 kHz. This is followed by filtration using a maeshori disk solvent-resistant membrane filter with a pore diameter of 0.2 μm (manufactured by Tosoh Corporation). After removal of the methanol from the filtrate using an evaporator, dissolution is performed with 10 mg of deuterochloroform containing trimethylsilane (TMS, 1% TMS) and this is analyzed by $^1$H-NMR. The content (A: μg/g) of the nonionic surfactant present in the toner is determined using a TMS intensity-referenced calibration curve constructed using the same nonionic surfactant as the nonionic surfactant contained in the toner. The calibration curve is constructed from the peak intensity ratio for the TMS intensity and the hydrogen of the oxyalkylene group at around 3.0 to 5.0 ppm.

The measurement instrument and measurement conditions are as follows.

instrument: JNM-EX400 FT-NMR instrument (JEOL Ltd.)
measurement frequency: 400 MHz
pulse condition: 5.0 μs
frequency range: 10500 Hz
number of scans: 1024
measurement temperature: 40° C.

<Determination of the Average Number of Moles of Addition for the Polyoxyalkylene Chain Used in the Nonionic Surfactant>

The average number of moles of addition for the polyoxyalkylene chain in the nonionic surfactant is measured in the present invention as described below using gel permeation chromatography (GPC). First, the polyoxyalkylene used to produce the nonionic surfactant is dissolved in tetrahydrofuran (THF) over 24 hours at room temperature. The obtained solution is filtered using a "MYSHORI Disk" solvent-resistant membrane filter with a pore diameter of 0.2 μm (Tosoh Corporation) to obtain a sample solution. The sample solution is produced so as to provide a concentration of THF-soluble components of approximately 0.8 mass %. Measurement is performed under the following conditions using this sample solution.

instrument: HLC8120 GPC (detector: RI) (Tosoh Corporation)
columns: 7 column train of Shodex KF-801, 802, 803, 804, 805, 806, and 807 (Showa Denko KK)
eluent: tetrahydrofuran (THF)
flowrate: 1.0 mL/min
oven temperature: 40.0° C.
sample injection quantity: 0.10 mL The sample molecular weight is determined using a molecular weight calibration curve constructed using standard polystyrene (for example, product name: "TSK Standard Polystyrene F-850, F-450, F-288, F-128, F-80, F-40, F-20, F-10, F-4, F-2, F-1, A-5000, A-2500, A-1000, A-500", Tosoh Corporation). The measured average molecular weight is divided by the unit molecular weight of the alkylene making up the polyoxyalkylene chain and the value truncated at the decimal point is used as the average number of moles of addition.

EXAMPLES

The present invention is more specifically described below using examples. The present invention is not limited by the following examples insofar as the essential features of the present invention are not exceeded. Unless specifically indicated otherwise, the number of parts and % in the examples and comparative examples are on a mass basis in all instances.

<Production of Polyoxyalkylene 1>

6.0 mass parts 5,10,15,20-tetraphenylporphyrin (TPP) was introduced into a flask equipped with a three-way cock; the interior of the flask was replaced with dry nitrogen; and 245 mass parts dichloromethane was then added and dissolution was carried out. To this solution was added 35.0 mass parts of a 5.0 mass % diethylaluminum chloride solution in solvent hexane and a reaction was run for 5 hours at room temperature. The reaction mixture was subjected to solvent removal under reduced pressure to obtain a 5,10,15,20-tetraphenylporphyrin (TPP) aluminum chloride catalyst.

1.2 mass parts of this TPP aluminum chloride catalyst was dissolved with 50 mass parts dichloromethane; the interior of the container was replaced with dry nitrogen; and cooling was performed on a liquid nitrogen bath. Into this was introduced 0.90 mass part purified ethylene oxide using the trap-to-trap method. After a reaction for 80 hours at room temperature under a nitrogen atmosphere, the polymerization reaction was stopped by the addition of 300 mass parts methanol. 3.0 mass parts active carbon was then introduced and stirring was performed for 3 hours and the catalyst present in the mixed solution was adsorbed to the active carbon. This was followed by filtration to remove the active carbon on which the catalyst had been adsorbed, and the solvent was then removed under reduced pressure to obtain polyoxyalkylene 1. A portion of the obtained polyoxyalkylene 1 was dissolved in tetrahydrofuran and its molecular weight distribution was measured by GPC. The average number of moles of alkylene oxide addition for the obtained polyoxyalkylene 1 is shown in Table 1.

<Production of Polyoxyalkylene 2>

A polyoxyalkylene 2 was obtained using the same method as for polyoxyalkylene 1, but using 0.90 mass part of a 9:1 mixture of purified ethylene oxide and purified propylene oxide where the 0.90 mass part purified ethylene oxide was used. The average number of moles of alkylene oxide addition for the obtained polyoxyalkylene 2 is shown in Table 1.

<Production of Polyoxyalkylene 3>

A polyoxyalkylene 3 was obtained using the same method as for polyoxyalkylene 1, but using 0.95 mass part of a 7:3 mixture of purified ethylene oxide and purified propylene oxide where the 0.90 mass part purified ethylene oxide was used. The average number of moles of alkylene oxide addition for the obtained polyoxyalkylene 3 is shown in Table 1.

<Production of Polyoxyalkylene 4>

A polyoxyalkylene 4 was obtained using the same method as for polyoxyalkylene 1, but using 1.02 mass parts of a 4:5 mixture of purified ethylene oxide and purified propylene oxide where the 0.90 mass part purified ethylene oxide was used. The average number of moles of alkylene oxide addition for the obtained polyoxyalkylene 4 is shown in Table 1.

<Production of Polyoxyalkylene 5>

A polyoxyalkylene 5 was obtained using the same method as for polyoxyalkylene 1, but using 1.15 mass parts of a 2:9 mixture of purified ethylene oxide and purified propylene oxide where the 0.90 mass part purified ethylene oxide was used. The average number of moles of alkylene oxide addition for the obtained polyoxyalkylene 5 is shown in Table 1.

<Production of Polyoxyalkylene 6>

A polyoxyalkylene 6 was obtained using the same method as for polyoxyalkylene 1, but using 1.16 mass parts of a 1:6 mixture of purified ethylene oxide and purified propylene oxide where the 0.90 mass part purified ethylene oxide was used. The average number of moles of alkylene oxide addition for the obtained polyoxyalkylene 6 is shown in Table 1.

<Production of Polyoxyalkylene 7>

A polyoxyalkylene 7 was obtained using the same method as for polyoxyalkylene 1, but using 0.90 mass part of a 20:1 mixture of purified ethylene oxide and purified propylene oxide where the 0.90 mass part purified ethylene oxide was used. The average number of moles of alkylene oxide addition for the obtained polyoxyalkylene 7 is shown in Table 1.

<Production of Polyoxyalkylene 8>

A polyoxyalkylene 8 was obtained using the same method as for polyoxyalkylene 1, but using 0.93 mass part of a 20:3 mixture of purified ethylene oxide and purified propylene oxide where the 0.90 mass part purified ethylene oxide was used. The average number of moles of alkylene oxide addition for the obtained polyoxyalkylene 8 is shown in Table 1.

<Production of Polyoxyalkylene 9>

A polyoxyalkylene 9 was obtained using the same method as for polyoxyalkylene 1, but using 1.03 mass parts of a 1:1 mixture of purified ethylene oxide and purified propylene oxide where the 0.90 mass part purified ethylene oxide was used. The average number of moles of alkylene oxide addition for the obtained polyoxyalkylene 9 is shown in Table 1.

<Production of Polyoxyalkylene 10>

A polyoxyalkylene 10 was obtained using the same method as for polyoxyalkylene 1, but using 0.90 mass part of a 50:1 mixture of purified ethylene oxide and purified propylene oxide where the 0.90 mass part purified ethylene oxide was used. The average number of moles of alkylene oxide addition for the obtained polyoxyalkylene 10 is shown in Table 1.

<Polyoxyalkylene 11>

A commercial pentaethylene glycol (Tokyo Chemical Industry Co., Ltd.) was used as polyoxyalkylene 11. The number of moles of alkylene oxide addition is 5.

<Polyoxyalkylene 12>

A commercial polyethylene glycol (PEG-1450, Sanyo Chemical Industries, Ltd.) was used as polyoxyalkylene 12. The average number of moles of alkylene oxide addition is shown in Table 1.

<Polyoxyalkylene 13>

A commercial polyethylene glycol (PEG-2000, Sanyo Chemical Industries, Ltd.) was used as polyoxyalkylene 13. The average number of moles of alkylene oxide addition is shown in Table 1.

<Polyoxyalkylene 14>

A commercial polyethylene glycol (PEG-4000N, Sanyo Chemical Industries, Ltd.) was used as polyoxyalkylene 14. The average number of moles of alkylene oxide addition is shown in Table 1.

<Production of polyoxyalkylene 15>

A polyoxyalkylene 15 was obtained using the same method as for polyoxyalkylene 1, but using 1.16 mass parts of a 4:25 mixture of purified ethylene oxide and purified propylene oxide where the 0.90 mass part purified ethylene oxide was used. The average number of moles of alkylene oxide addition for the obtained polyoxyalkylene 15 is shown in Table 1.

TABLE 1

| | polyoxyalkylene structure (EO:PO integral ratio) | average addition mole number of oxyalkylene |
|---|---|---|
| polyoxyalkylene 1 | only EO | 10 |
| polyoxyalkylene 2 | 9:1 | 10 |
| polyoxyalkylene 3 | 7:3 | 10 |
| polyoxyalkylene 4 | 4:5 | 10 |
| polyoxyalkylene 5 | 2:9 | 10 |
| polyoxyalkylene 6 | 1:6 | 10 |
| polyoxyalkylene 7 | 20:1 | 10 |
| polyoxyalkylene 8 | 20:3 | 10 |
| polyoxyalkylene 9 | 1:1 | 10 |
| polyoxyalkylene 10 | 50:1 | 10 |
| polyoxyalkylene 11 | only EO | 5 |
| polyoxyalkylene 12 | only EO | 32 |
| polyoxyalkylene 13 | only EO | 45 |
| polyoxyalkylene 14 | only EO | 68 |
| polyoxyalkylene 15 | 4:25 | 10 |

EO: oxyethylene group
PO: oxypropylene group

<Production of Nonionic Surfactant 1>

10.0 mass parts polyoxyalkylene 1 was reacted with 0.15 mass part sodium metal while heating and stirring in a three-neck flask fitted with a reflux condenser and a stirrer. To this was then gradually added a mixture of 1.5 mass parts n-chlorododecane and 50 mass parts hexane and a reaction was run for 3 hours at 120° C. After the reaction solution had been cooled, the reaction solution was neutralized with a large amount of acetone and the precipitated sodium chloride reaction by-product was filtered off. Purification by molecular distillation then yielded nonionic surfactant 1. The properties of the obtained nonionic surfactant 1 are shown in Table 2.

<Production of Nonionic Surfactant 2>

Nonionic surfactant 2 was obtained by the same method as for nonionic surfactant 1, but using 10.0 mass parts polyoxyalkylene 2 where 10.0 mass parts polyoxyalkylene 1 was used. The properties of the obtained nonionic surfactant 2 are shown in Table 2.

<Production of Nonionic Surfactant 3>

Nonionic surfactant 3 was obtained by the same method as for nonionic surfactant 1, but using 11.0 mass parts polyoxyalkylene 3 where 10.0 mass parts polyoxyalkylene 1 was used. The properties of the obtained nonionic surfactant 3 are shown in Table 2.

<Production of Nonionic Surfactant 4>

Nonionic surfactant 4 was obtained by the same method as for nonionic surfactant 1, but using 12.0 mass parts polyoxyalkylene 4 where 10.0 mass parts polyoxyalkylene 1 was used. The properties of the obtained nonionic surfactant 4 are shown in Table 2.

<Production of Nonionic Surfactant 5>

Nonionic surfactant 5 was obtained by the same method as for nonionic surfactant 1, but using 12.8 mass parts polyoxyalkylene 5 where 10.0 mass parts polyoxyalkylene 1 was used. The properties of the obtained nonionic surfactant 5 are shown in Table 2.

<Production of Nonionic Surfactant 6>

Nonionic surfactant 6 was obtained by the same method as for nonionic surfactant 1, but using 12.9 mass parts polyoxyalkylene 6 where 10.0 mass parts polyoxyalkylene 1 was used. The properties of the obtained nonionic surfactant 6 are shown in Table 2.

<Production of Nonionic Surfactant 7>

Nonionic surfactant 7 was obtained by the same method as for nonionic surfactant 1, but using 10.0 mass parts polyoxyalkylene 7 where 10.0 mass parts polyoxyalkylene 1 was used. The properties of the obtained nonionic surfactant 7 are shown in Table 2.

<Production of Nonionic Surfactant 8>

Nonionic surfactant 8 was obtained by the same method as for nonionic surfactant 1, but using 10.5 mass parts polyoxyalkylene 8 where 10.0 mass parts polyoxyalkylene 1 was used. The properties of the obtained nonionic surfactant 8 are shown in Table 2.

<Production of Nonionic Surfactant 9>

Nonionic surfactant 9 was obtained by the same method as for nonionic surfactant 1, but using 11.7 mass parts polyoxyalkylene 9 where 10.0 mass parts polyoxyalkylene 1 was used. The properties of the obtained nonionic surfactant 9 are shown in Table 2.

<Production of Nonionic Surfactant 10>

Nonionic surfactant 10 was obtained by the same method as for nonionic surfactant 1, but using 10.0 mass parts polyoxyalkylene 10 where 10.0 mass parts polyoxyalkylene 1 was used. The properties of the obtained nonionic surfactant 10 are shown in Table 2.

<Production of Nonionic Surfactant 11>

Nonionic surfactant 11 was obtained by the same method as for nonionic surfactant 1, but using 10.0 mass parts polyoxyalkylene 10 where 10.0 mass parts polyoxyalkylene 1 was used and using 1.6 mass parts n-dodecanoyl chloride where 1.5 mass parts n-chlorododecane was used. The properties of the obtained nonionic surfactant 11 are shown in Table 2.

<Production of Nonionic Surfactant 12>

Nonionic surfactant 12 was obtained by the same method as for nonionic surfactant 1, but using 11.7 mass parts polyoxyalkylene 9 where 10.0 mass parts polyoxyalkylene 1 was used and using 1.6 mass parts n-dodecanoyl chloride where 1.5 mass parts n-chlorododecane was used. The properties of the obtained nonionic surfactant 12 are shown in Table 2.

<Production of Nonionic Surfactant 13>

Nonionic surfactant 13 was obtained by the same method as for nonionic surfactant 1, but using 12.8 mass parts polyoxyalkylene 5 where 10.0 mass parts polyoxyalkylene 1 was used and using 1.6 mass parts n-dodecanoyl chloride where 1.5 mass parts n-chlorododecane was used. The properties of the obtained nonionic surfactant 13 are shown in Table 2.

<Nonionic Surfactant 14>

A purified commercial product (from Tokyo Chemical Industry Co., Ltd., polyoxyethylene nonylphenyl ether, average number of moles of ethylene oxide addition=10) was used as nonionic surfactant 14. The properties of nonionic surfactant 14 are shown in Table 2.

<Production of Nonionic Surfactant 15>

Nonionic surfactant 15 was obtained by the same method as for nonionic surfactant 1, but using 5.0 mass parts polyoxyalkylene 11 where 10.0 mass parts polyoxyalkylene 1 was used. The properties of the obtained nonionic surfactant 15 are shown in Table 2.

<Production of Nonionic Surfactant 16>

Nonionic surfactant 16 was obtained by the same method as for nonionic surfactant 1, but using 32.0 mass parts polyoxyalkylene 12 where 10.0 mass parts polyoxyalkylene 1 was used. The properties of the obtained nonionic surfactant 16 are shown in Table 2.

<Production of Nonionic Surfactant 17>

Nonionic surfactant 17 was obtained by the same method as for nonionic surfactant 1, but using 45.0 mass parts polyoxyalkylene 13 where 10.0 mass parts polyoxyalkylene 1 was used. The properties of the obtained nonionic surfactant 17 are shown in Table 2.

<Production of Nonionic Surfactant 18>

Nonionic surfactant 18 was obtained by the same method as for nonionic surfactant 1, but using 68.0 mass parts polyoxyalkylene 14 where 10.0 mass parts polyoxyalkylene 1 was used. The properties of the obtained nonionic surfactant 18 are shown in Table 2.

<Production of Nonionic Surfactant 19>

Nonionic surfactant 19 was obtained by the same method as for nonionic surfactant 1, but using 12.9 mass parts polyoxyalkylene 15 where 10.0 mass parts polyoxyalkylene 1 was used. The properties of the obtained nonionic surfactant 19 are shown in Table 2.

<Production of Nonionic Surfactant 20>

Nonionic surfactant 20 was obtained by the same method as for nonionic surfactant 1, but using 10.0 mass parts polyoxyalkylene 7 where 10.0 mass parts polyoxyalkylene 1 was used and using 0.8 mass part n-chloropentane where 1.5 mass parts n-chlorododecane was used. The properties of the obtained nonionic surfactant 20 are shown in Table 2.

<Production of Nonionic Surfactant 21>

Nonionic surfactant 21 was obtained by the same method as for nonionic surfactant 1, but using 10.0 mass parts polyoxyalkylene 7 where 10.0 mass parts polyoxyalkylene 1 was used and using 2.8 mass part n-chloropentacosane where 1.5 mass parts n-chlorododecane was used. The properties of the obtained nonionic surfactant 21 are shown in Table 2.

<Nonionic Surfactant 22>

A commercial product (ADEKA Corporation, Adeka Pluronic F-108, average number of moles of ethylene oxide addition=300, average number of moles of propylene oxide addition=55) was used as nonionic surfactant 22. The properties of nonionic surfactant 22 are shown in Table 2.

<Nonionic Surfactant 23>

A commercial product (ADEKA Corporation, Adeka Pluronic L-44, average number of moles of ethylene oxide addition=20, average number of moles of propylene oxide addition=20) was used as nonionic surfactant 23. The properties of nonionic surfactant 23 are shown in Table 2.

<Production of Nonionic Surfactant 24>

10.0 mass parts polypropylene glycol (13 mol adduct) and 0.03 mass part sodium hydroxide were introduced into a pressure-resistant container and were heated to 150° C. while stirring. This was followed by the addition of 180 mass parts ethylene oxide under pressurization and an addition reaction was run while holding the temperature at 150° C. Purification was then performed by molecular distillation to obtain nonionic surfactant 24. The properties of the obtained nonionic surfactant 24 are shown in Table 2.

<Production of Nonionic Surfactant 25>

Nonionic surfactant 25 was obtained by the same production method as for nonionic surfactant 24, but changing the 10.0 mass parts polypropylene glycol (13 mol adduct) to 100 mass parts propylene glycol (30 mole adduct) and changing the ethylene oxide to 19.5 mass parts. The properties of the obtained nonionic surfactant 25 are shown in Table 2.

TABLE 2

| | used polyoxyalkylene | type | type of hydrophobic group | average addition mole number of oxyalkylene | PO/EO |
|---|---|---|---|---|---|
| nonionic surfactant 1 | polyoxyalkylene 1 | alkyl ether | straight chain alkyl group, carbon number 12 | 10 | 0.000 |
| nonionic surfactant 2 | polyoxyalkylene 2 | alkyl ether | straight chain alkyl group, carbon number 12 | 10 | 0.111 |
| nonionic surfactant 3 | polyoxyalkylene 3 | alkyl ether | straight chain alkyl group, carbon number 12 | 10 | 0.429 |
| nonionic surfactant 4 | polyoxyalkylene 4 | alkyl ether | straight chain alkyl group, carbon number 12 | 10 | 1.250 |
| nonionic surfactant 5 | polyoxyalkylene 5 | alkyl ether | straight chain alkyl group, carbon number 12 | 10 | 4.500 |
| nonionic surfactant 6 | polyoxyalkylene 6 | alkyl ether | straight chain alkyl group, carbon number 12 | 10 | 6.000 |
| nonionic surfactant 7 | polyoxyalkylene 7 | alkyl ether | straight chain alkyl group, carbon number 12 | 10 | 0.050 |
| nonionic surfactant 8 | polyoxyalkylene 8 | alkyl ether | straight chain alkyl group, carbon number 12 | 10 | 0.150 |
| nonionic surfactant 9 | polyoxyalkylene 9 | alkyl ether | straight chain alkyl group, carbon number 12 | 10 | 1.000 |
| nonionic surfactant 10 | polyoxyalkylene 10 | alkyl ether | straight chain alkyl group, carbon number 12 | 10 | 0.020 |
| nonionic surfactant 11 | polyoxyalkylene 10 | alkyl ester | straight chain alkyl group, carbon number 12 | 10 | 0.020 |
| nonionic surfactant 12 | polyoxyalkylene 9 | alkyl ester | straight chain alkyl group, carbon number 12 | 10 | 1.000 |
| nonionic surfactant 13 | polyoxyalkylene 5 | alkyl ester | straight chain alkyl group, carbon number 12 | 10 | 4.500 |
| nonionic surfactant 14 | — | phenyl ether | nonylphenyl group | 10 | 0.000 |
| nonionic surfactant 15 | polyoxyalkylene 11 | alkyl ether | straight chain alkyl group, carbon number 12 | 5 | 0.000 |
| nonionic surfactant 16 | polyoxyalkylene 12 | alkyl ether | straight chain alkyl group, carbon number 12 | 32 | 0.000 |
| nonionic surfactant 17 | polyoxyalkylene 13 | alkyl ether | straight chain alkyl group, carbon number 12 | 45 | 0.000 |
| nonionic surfactant 18 | polyoxyalkylene 14 | alkyl ether | straight chain alkyl group, carbon number 12 | 68 | 0.000 |
| nonionic surfactant 19 | polyoxyalkylene 15 | alkyl ether | straight chain alkyl group, carbon number 12 | 10 | 6.250 |
| nonionic surfactant 20 | polyoxyalkylene 7 | alkyl ether | straight chain alkyl group, carbon number 5 | 10 | 0.050 |
| nonionic surfactant 21 | polyoxyalkylene 7 | alkyl ether | straight chain alkyl group, carbon number 25 | 10 | 0.050 |
| nonionic surfactant 22 | — | pluronic type | polyoxy-propylene | — | 0.183 |
| nonionic surfactant 23 | — | pluronic type | polyoxy-propylene | — | 1.000 |
| nonionic surfactant 24 | — | pluronic type | polyoxy-propylene | — | 0.043 |
| nonionic surfactant 25 | — | pluronic type | polyoxy-propylene | — | 4.286 |

PO/EO: ratio of the number of moles of the oxypropylene group present in the nonionic surfactant to the number of moles of the oxyethylene group <Production of Fluid Toner Particle Dispersion 1>

100 mass parts styrene monomer, 25 mass parts C.I. Pigment Blue 15:3, and 2.0 mass parts aluminum 3,5-di-tert-butylsalicylate compound (Bontron E88 from Orient Chemical Industries Co., Ltd.) were prepped. These were introduced into an attritor from Mitsui Mining Co., Ltd. (today's Nippon Coke & Engineering Co., Ltd) and a fluid masterbatch dispersion was prepared by stirring for 300 minutes at 25° C. and 200 rpm using zirconia beads (140 mass parts) having a radius of 1.25 mm.

An aqueous medium containing a calcium phosphate compound was obtained by introducing 285 mass parts of a 0.1 mol/liter aqueous $Na_3PO_4$ solution into 450 mass parts ion-exchanged water; heating to 60° C.; and then gradually adding 15 mass parts of a 1.0 mol/liter aqueous $CaCl_2$ solution.

| | |
|---|---|
| the fluid masterbatch dispersion | 25 mass parts |
| styrene monomer | 40 mass parts |
| n-butyl acrylate monomer | 28 mass parts |
| low molecular weight polystyrene (Mw = 3,000, Mn = 1,050, Tg = 55° C.) | 15 mass parts |
| hydrocarbon wax (Fischer-Tropsch wax, peak temperature of the highest endothermic peak = 78° C., Mw = 750) | 8 mass parts |

-continued

| | |
|---|---|
| polyester resin (polycondensate of terephthalic acid/isophthalic acid/propylene oxide-modified bisphenol A (2 mol adduct)/ethylene oxide-modified bisphenol A (2 mol adduct) = 30/30/30/10 (mass basis), acid value = 11 mg KOH/g, Tg = 74° C., Mw = 11,000, Mn = 4,000) | 5.5 mass parts |

The preceding starting materials were heated to 65° C., and dispersed and dissolved uniformly at 5,000 rpm using a T.K. Homomixer (Tokushu Kika Kogyo Co., Ltd.). Into this was dissolved 8 mass parts of a 70% toluene solution of the polymerization initiator 1,1,3,3-tetramethylbutylperoxy 2-ethylhexanoate to prepare a polymerizable monomer composition.

This polymerizable monomer composition was introduced into the previously described aqueous medium and the polymerizable monomer composition was granulated by stirring for 10 minutes at 65° C. under an $N_2$ atmosphere at 12,000 rpm using a T.K. Homomixer. Heating to a temperature of 67° C. was then carried out while stirring with paddle stirring blades, and, when the polymerization conversion of the polymerizable vinyl monomer had reached 90%, the pH of the aqueous dispersion medium was adjusted to 9 by the addition of an aqueous 0.1 mol/liter sodium hydroxide solution. Heating to 80° C. was carried out at a temperature rise rate of 40° C./h and a reaction was run for 5 hours. After the completion of the polymerization reaction, the residual monomer in the toner particles was distilled out under reduced pressure. The aqueous medium was cooled to obtain a fluid dispersion of toner particles 1. The weight-average particle diameter (D4) of toner particles 1 was 5.8 μm.

<Production of Fluid Toner Particle Dispersion 2>

(Preparation of a Resin Fine Particle Fluid Dispersion)

| | |
|---|---|
| styrene | 210 mass parts |
| n-butyl acrylate | 90 mass parts |
| copolymer of 2-acrylamido-2-methylpropanesulfonic acid/styrene/2-ethylhexyl acrylate = 6/74/20 (mass basis) (acid value = 16 mg KOH/g, Mw = 18,000) | 2.1 mass parts |
| copolymer of styrene/methyl methacrylate/methacrylic acid (copolymer ratio (mass basis) = 95.85/2.50/1.65, acid value = 21.0 mg KOH/g, Mw = 15,000) | 60 mass parts |
| dodecanethiol | 20 mass parts |
| carbon tetrabromide | 4 mass parts |

The components listed above were mixed and dissolved. A solution prepared by dissolving 10 g of the anionic surfactant Neogen SC (Dai-ichi Kogyo Seiyaku Co., Ltd.) and 6 g of the nonionic surfactant Nonipol 400 (Kao Corporation) in 500 g ion-exchanged water was introduced into a flask. To this was added the aforementioned liquid mixture with dispersion and emulsification, and, while gently stirring·mixing for 10 minutes, 50 g ion-exchanged water in which 4 g ammonium persulfate was dissolved was introduced. Then, after thoroughly replacing the interior with nitrogen, the interior was heated to 70° C. on an oil bath while the flask was stirred. The emulsion polymerization was continued in this state for 5 hours. This yielded a resin fine particle fluid dispersion.

(Preparation of a Fluid Colorant Particle Dispersion)

| | |
|---|---|
| C.I. Pigment Blue 15:3 | 50 mass parts |
| nonionic surfactant "Nonipol 400" (Kao Corporation) | 5 mass parts |
| ion-exchanged water | 200 mass parts |

The components listed above were mixed and dissolved and were dispersed for 10 minutes with an homogenizer (Ultra-Turrax, IKA) to give a fluid colorant particle dispersion.

<Production of a wax particle fluid dispersion>

| | |
|---|---|
| stearyl stearate wax (peak temperature of highest endothermic peak = 60° C.) | 50 mass parts |
| cationic surfactant "Sanisol B50" (Kao Corporation) | 5 mass parts |
| ion-exchanged water | 200 mass parts |

The components listed above were heated to 95° C.; thoroughly dispersed using an Ultra-Turrax 150 from IKA; and then dispersed by processing with a pressurized discharge-type homogenizer to obtain a wax particle fluid dispersion.

| | |
|---|---|
| resin fine particle fluid dispersion | 200 mass parts |
| fluid colorant particle dispersion | 80 mass parts |
| wax particle fluid dispersion | 50 mass parts |
| calcium bicarbonate | 3.5 mass parts |
| aluminum compound of 3,5-di-tert-butylsalicylate (Bontron E88 from Orient Chemical Industries Co., Ltd.) | 2.5 mass parts |

The components listed above were thoroughly mixed and dispersed in a roundbottom stainless steel flask using an Ultra-Turrax T50 from IKA and the flask was then heated to 51° C. on an oil heating bath while stirring. After holding for 60 minutes at 51° C., another 60 mass parts of the same resin fine particle fluid dispersion as described above was slowly added. The pH in the system was subsequently adjusted to 6.5 using an aqueous sodium hydroxide solution with a concentration of 0.5 mol/liter; the stainless steel flask was then tightly closed and the seal on the stirring shaft was magnetically sealed; heating to 97° C. was carried out while continuing to stir; and holding was performed for 3 hours. Cooling then yielded a fluid dispersion of toner particles 2. Toner particles 2 had a weight-average particle diameter (D4) of 5.9 μm.

<Production of Fluid Toner Particle Dispersion 3>

| | |
|---|---|
| polyester A (polycondensate of terephthalic acid/isophthalic acid/propylene oxide-modified bisphenol A (2 mol adduct)/ethylene oxide-modified bisphenol A (2 mol adduct) = 14/14/10/62 (mass basis), Mw = 7,000, Mn = 3,200, Tg = 57° C.) | 40 mass parts |
| polyester B (polycondensate of isophthalic acid/propylene oxide-modified bisphenol A (2 mol adduct)/ethylene oxide-modified bisphenol A (2 mol adduct) = 28/10/62 (mass basis), Mw = 11,000, Mn = 4,200, Tg = 52° C.) | 40 mass parts |
| methyl ethyl ketone | 80 mass parts |
| ethyl acetate | 80 mass parts |
| ester wax (melting point = 73° C.) | 15 mass parts |
| C.I. Pigment Blue 15:3 | 5 mass parts |
| aluminum compound of 3,5-di-tert-butylsalicylate (Bontron E88, Orient Chemical Industries Co., Ltd.) | 1 mass part |

A mixture of the preceding was dispersed for 3 hours using an attritor (Mitsui Mining & Smelting Co., Ltd.) to prepare a fluid dispersion. To a 2 liter four-neck flask equipped with a T.K. Homomixer high-speed stirrer were added 350 mass parts ion-exchanged water and 225 mass parts of an aqueous 0.1 mol/liter $Na_3PO_4$ solution. The homomixer rotation rate was adjusted to 10,000 rpm and heating was carried out to 65° C. To this was gradually added 34 mass parts of an aqueous 1.0 mol/liter $CaCl_2$ solution to produce an aqueous dispersion medium that contained the microfine poorly water-soluble dispersing agent $Ca_3(PO_4)_2$. 272 mass parts of the previously indicated fluid dispersion was introduced into the high-speed stirrer and granulated for 15 minutes at 65° C. while maintaining a stirring rate of 10,000 rpm. This was followed by transfer from the high-speed stirrer to a standard propeller stirrer and, while maintaining 150 rpm for the stirrer rotation rate, the internal temperature was raised to 95° C. and this was maintained for 3 hours to remove the solvent from the fluid dispersion. Cooling then yielded a fluid dispersion of toner particles 3. Toner particles 3 had a weight-average particle diameter (D4) of 5.9 μm.

Example 1

Hydrochloric acid was added to the fluid dispersion of toner particles 1 to bring the pH to 1.4 and the calcium phosphate salt was dissolved by stirring for 1 hour. Using a discharge pump, this fluid dispersion of toner particles 1, in which the calcium phosphate salt was dissolved, was continuously discharged and continuously transported at 20 kg/h to a belt filter (Synchro-Filter from Tsukishima Kikai Co., Ltd.) and was dewatered·washed using the conditions given below to give a wet toner particle cake. The nonionic surfactant-containing wash water referenced below had the composition given in Table 3.

<Dewatering and Washing Conditions Used at the Belt Filter> slurry feed rate: 20 kg/h feed rate for nonionic surfactant-containing wash water: 7.3 kg/h vacuum: −70 kPa (70 kPa reduction from atmospheric pressure)

The cake was then pulverized and dried until the water content of the toner reached to 2.0 mass % or less. A moderate quantity of coarse particles and microfine particles was subsequently removed by air classification. Finally, a hydrophobic silica fine powder (number-average primary particle diameter: 10 nm) that had been surface-treated with hexamethyldisilazane was added at 1.5 mass % with reference to the toner particles.

A mixing process was carried out for 300 seconds with a Henschel mixer (Mitsui Mining Co., Ltd.) followed by a sieving operation to obtain toner 1. The properties of toner 1 are shown in Table 3.

<Confirmation of the Nonionic Surfactant Held by the Toner>

The following procedure was used to confirm that the nonionic surfactant at the toner surface had not undergone modification or alteration.

(1) 100 g toner 1 was weighed out and added to a sample bin that contained 1.2 liter methanol. After thorough mixing, exposure to ultrasound was performed for 5 minutes using a desktop ultrasound cleaner ("B2510J-MTH" (product name), Branson) having an output of 125 W and oscillating at 42 kHz. Filtration was then carried out using a solvent-resistant membrane filter having a pore diameter of 0.2 μm.

The resulting methanol solution filtrate was sequentially trapped on a cation exchanger and an anion exchanger and the methanol solution that had sequentially passed through these ion exchangers was recovered. The methanol solution was subsequently concentrated under reduced pressure at 25° C. until no reduction in mass was seen.

(2) The process in (1) was performed 10 times to obtain at least 1 g of the concentrate. This concentrate was subjected to silica gel column chromatography using a developing solvent (solvent of ethyl acetate:acetone:water=55:35:10). 20 fractions were taken from the development zone in which compounds originating from the concentrate were present, and the developing solvent was evaporated under reduced pressure at 80° C. until no reduction in mass was seen. An ammonium cobalt thiocyanate color test was carried out on the compounds obtained by this fractionation. Specifically, 5 mL ammonium cobalt thiocyanate reagent, 5 mL chloroform, and 5 mL of a 1 mass % methanolic solution of the compounds was mixed and vigorously shaken, followed by quiescence. This ammonium cobalt thiocyanate reagent was prepared by the dissolution of 174 g ammonium thiocyanate and 28 g cobalt nitrate in 1 liter water. After quiescence, a solution in which the chloroform layer gave a blue color indicated the presence of a polyoxyethylene-type surfactant.

(3) The compounds separated by the aforementioned column chromatography and giving a blue color in the color test using the ammonium cobalt thiocyanate reagent were dissolved in a small amount of methanol and were transferred to a single container. The nonionic surfactant was recovered by evaporating the methanol under reduced pressure at 40° C. until no reduction in mass was seen.

(4) 10 mg deuterochloroform was added to 3 mg of the recovered nonionic surfactant, which was dissolved and submitted to $^1$H-NMR analysis. The results of the analysis confirmed a nonionic surfactant for which the [PO/EO] ratio was 0.05 and the hydrophobic group was a long-chain alkyl group with an average of 12 carbons. Since this was a nonionic surfactant in which the hydrophobic group was a long-chain alkyl group, the number of moles of addition for the EO group and PO group was calculated based on the terminal $CH_3$ group. The results were 9.5 moles of addition for the EO group and 0.5 mole of addition for the PO group.

(5) The value of A (μg/g) was measured using the same procedure as above for measuring the nonionic surfactant content (A:μg/g) of the toner surface, with the exception that the nonionic surfactant recovered in (3) above was used as the reference material and a TMS intensity-based calibration curve was constructed by $^1$H-NMR. The result was 990 μg/g. That is, no significant difference was seen between the value of A quantitated with the surfactant used being employed as the reference material (Table 3, refer to Example 1, 990 μg/g) and the value of A (μg/g) quantitated with the surfactant extracted from the toner by the instant method being employed as the reference material.

<Image Evaluation>

Image evaluation for the present invention employed an LBP9500C printer from Canon that had been modified to give a print out speed of 57 sheets/minute for the A4 size. 280.0 g (±3.0 g) toner 1 was filled into a cartridge. This cartridge for image output was mounted in the black station and dummy cartridges were mounted elsewhere and image evaluation was then carried out.

In the image evaluation, an image with a 1% print percentage was continuously output in each of the following environments: 23° C./55% RH (ambient temperature, ambient humidity environment), 30° C./80% RH (high temperature, high humidity environment), and 15° C./10% RH (low temperature, low humidity environment). 22,000 copies of the image were ultimately output and the following items were evaluated. The results are shown in Table 4.

<Evaluation of Fogging>

After 22,000 copies had been output, an image having a white background region was output using Xerox Business 4200 paper (Xerox Inc., 75 g/m$^2$). In the case of the high temperature, high humidity environment, the measurement was performed after standing for 48 hours after the output of the 22,000 copies. A Model TC-6DS Reflectometer from Tokyo Denshoku Co., Ltd., was used as the measurement instrument. The fogging value was calculated as the fogging density (%) (=Dr (%)−Ds (%)) from the difference between the whiteness (reflectance Ds (%)) of the white background region of the printed out image and the whiteness (average reflectance Dr (%)) of the image-forming region. The whiteness of the white background region is the whiteness of the paper itself. A label about 50 mm on a side was stuck on the paper in advance when printing was carried out. The paper region covered by this was not involved in image formation and could therefore be measured for the whiteness of the white background region. An amber filter was used for the filter.

<Image Density>

Immediately after completion of the output of the 22,000 copies, a solid black image was output using Xerox Business 4200 paper (Xerox Inc., 75 g/m$^2$) and the evaluation was carried out by measuring its density. In the case of the high temperature, high humidity environment, the measurement was performed after standing for 48 hours after the output of the 22,000 copies. A MacBeth RD918 Reflection Densitometer (MacBeth) was used to measure the image density. The relative density of the white background region where the original had a density of 0.00 was measured with respect to the image. In the evaluation in the present invention, a density of less than 1.20 is scored as undesirable due to the necessity to supplement main unit control.

<Development Stripes>

After completion of the 22,000 copy print-out test, a halftone image (toner placement quantity: 0.6 mg/cm$^2$) was printed out on transfer paper (75 g/m$^2$, A4 size paper) and the number of development stripes was evaluated.

<Charging Member Contamination>

After completion of the 22,000 copy print-out test, the presence/absence of a periodic shading variation having the width of the roller circumference was visually evaluated on a halftone image.

A: shading variation was absent

B: the appearance of a slight shading variation could be confirmed when the image was held up to a light C: a moderate shading variation appeared on the image D: a substantial shading variation appeared on the image

Examples 2 to 38 and Example 40

Toners 2 to 38 and toner 40 were obtained by carrying out investigations as in Example 1, with the exception that the fluid toner dispersion used in Example 1 was changed to the composition shown in Table 3 and the nonionic surfactant-containing wash water used in Example 1 was changed to the composition shown in Table 3. The properties of the toners are shown in Table 3 and the results of the evaluations are shown in Table 4.

Example 39

A toner cake was obtained by subjecting the fluid dispersion of toner particles 2 to solid-liquid separation at a pressure of 0.4 MPa using a pressure filter with a capacity of 10 L. After this, ion-exchanged water was added to the pressure filter to capacity and washing was performed at a pressure of 0.4 MPa. This same washing procedure was performed an additional 8 times. On the 9th wash, the nonionic surfactant-containing wash water shown for Example 39 in Table 3 was added to the pressure filter to capacity and washing was carried out under the same conditions as before.

The obtained toner particle cake was pulverized and drying was performed until the water content in the toner reached 2.0 mass % or below. A moderate quantity of coarse particles and microfine particles was then removed by air classification. Finally, a hydrophobic silica fine powder (number-average primary particle diameter: 10 nm) that had been surface-treated with hexamethyldisilazane was added at 1.5 mass % with reference to the toner particles. A mixing process was carried out for 300 seconds with a Henschel mixer (Mitsui Mining Co., Ltd.) followed by a sieving operation to obtain toner 39. The properties of the toner are shown in Table 3 and the results of the evaluations are shown in Table 4.

Comparative Examples 1 to 6

Comparative toners 1 to 6 were obtained by carrying out investigations as in Example 1, with the exception that the fluid toner dispersion used in Example 1 was changed to the composition shown in Table 5 and the nonionic surfactant-containing wash water used in Example 1 was changed to the composition shown in Table 5. The properties of the toners are shown in Table 5 and the results of the evaluations are shown in Table 6.

TABLE 3

| | | nonionic surfactant-containing wash water | | | | | toner properties | | |
|---|---|---|---|---|---|---|---|---|---|
| Examples | fluid toner particle dispersion | used surfactant (1) | used surfactant (2) | (1):(2) (molar ratio) | nonionic surfactant content in the wash water | toner no. | A (mg/g) | A/B | PO/EO |
| Example 1 | fluid dispersion 1 | surfactant 1 | surfactant 2 | 1:1 | 0.70 mass % | toner 1 | 990 | 900 | 0.053 |
| Example 2 | fluid dispersion 1 | surfactant 1 | surfactant 3 | 5:4 | 0.70 mass % | toner 2 | 960 | 873 | 0.154 |
| Example 3 | fluid dispersion 1 | surfactant 1 | surfactant 4 | 1:9 | 0.70 mass % | toner 3 | 1010 | 918 | 1.000 |
| Example 4 | fluid dispersion 1 | surfactant 1 | surfactant 5 | 1:11 | 0.70 mass % | toner 4 | 990 | 900 | 3.000 |
| Example 5 | fluid dispersion 1 | surfactant 1 | surfactant 2 | 4:1 | 0.70 mass % | toner 5 | 1040 | 945 | 0.020 |
| Example 6 | fluid dispersion 1 | surfactant 1 | surfactant 6 | 1:21 | 0.70 mass % | toner 6 | 960 | 873 | 4.500 |
| Example 7 | fluid dispersion 1 | surfactant 22 | — | only (1) | 0.70 mass % | toner 7 | 1000 | 909 | 0.183 |
| Example 8 | fluid dispersion 1 | surfactant 23 | — | only (1) | 0.70 mass % | toner 8 | 1010 | 918 | 1.000 |
| Example 9 | fluid dispersion 1 | surfactant 24 | — | only (1) | 0.70 mass % | toner 9 | 960 | 873 | 0.043 |
| Example 10 | fluid dispersion 1 | surfactant 25 | — | only (1) | 0.70 mass % | toner 10 | 1000 | 909 | 4.286 |
| Example 11 | fluid dispersion 1 | surfactant 7 | — | only (1) | 0.70 mass % | toner 11 | 940 | 855 | 0.050 |
| Example 12 | fluid dispersion 1 | surfactant 8 | — | only (1) | 0.70 mass % | toner 12 | 970 | 882 | 0.150 |
| Example 13 | fluid dispersion 1 | surfactant 9 | — | only (1) | 0.70 mass % | toner 13 | 990 | 900 | 1.000 |
| Example 14 | fluid dispersion 1 | surfactant 10 | — | only (1) | 0.70 mass % | toner 14 | 990 | 900 | 0.020 |
| Example 15 | fluid dispersion 1 | surfactant 5 | — | only (1) | 0.70 mass % | toner 15 | 1010 | 918 | 4.500 |
| Example 16 | fluid dispersion 1 | surfactant 1 | surfactant 2 | 1:1 | 0.40 mass % | toner 16 | 550 | 500 | 0.053 |
| Example 17 | fluid dispersion 1 | surfactant 1 | surfactant 2 | 1:1 | 2.20 mass % | toner 17 | 3300 | 3000 | 0.053 |
| Example 18 | fluid dispersion 1 | surfactant 1 | surfactant 2 | 4:1 | 0.07 mass % | toner 18 | 140 | 127 | 0.020 |
| Example 19 | fluid dispersion 1 | surfactant 1 | surfactant 2 | 4:1 | 7.00 mass % | toner 19 | 9350 | 8500 | 0.020 |
| Example 20 | fluid dispersion 1 | surfactant 1 | surfactant 6 | 1:21 | 0.08 mass % | toner 20 | 140 | 127 | 4.500 |

TABLE 3-continued

| Examples | fluid toner particle dispersion | nonionic surfactant-containing wash water used surfactant (1) | used surfactant (2) | (1):(2) (molar ratio) | nonionic surfactant content in the wash water | toner no. | toner properties A (mg/g) | A/B | PO/EO |
|---|---|---|---|---|---|---|---|---|---|
| Example 21 | fluid dispersion 1 | surfactant 1 | surfactant 6 | 1:21 | 7.06 mass % | toner 21 | 9350 | 8500 | 4.500 |
| Example 22 | fluid dispersion 1 | surfactant 24 | — | only (1) | 0.07 mass % | toner 22 | 140 | 127 | 0.043 |
| Example 23 | fluid dispersion 1 | surfactant 24 | — | only (1) | 7.00 mass % | toner 23 | 9350 | 8500 | 0.043 |
| Example 24 | fluid dispersion 1 | surfactant 25 | — | only (1) | 0.08 mass % | toner 24 | 140 | 127 | 4.286 |
| Example 25 | fluid dispersion 1 | surfactant 25 | — | only (1) | 7.05 mass % | toner 25 | 9350 | 8500 | 4.286 |
| Example 26 | fluid dispersion 1 | surfactant 11 | — | only (1) | 0.70 mass % | toner 26 | 1060 | 964 | 0.020 |
| Example 27 | fluid dispersion 1 | surfactant 12 | — | only (1) | 0.70 mass % | toner 27 | 1080 | 982 | 1.000 |
| Example 28 | fluid dispersion 1 | surfactant 13 | — | only (1) | 0.70 mass % | toner 28 | 1030 | 936 | 4.500 |
| Example 29 | fluid dispersion 1 | surfactant 14 | surfactant 2 | 4:1 | 0.07 mass % | toner 29 | 140 | 127 | 0.020 |
| Example 30 | fluid dispersion 1 | surfactant 14 | surfactant 2 | 4:1 | 7.00 mass % | toner 30 | 9350 | 8500 | 0.020 |
| Example 31 | fluid dispersion 1 | surfactant 14 | surfactant 6 | 1:21 | 0.07 mass % | toner 31 | 140 | 127 | 4.500 |
| Example 32 | fluid dispersion 1 | surfactant 14 | surfactant 6 | 1:21 | 6.98 mass % | toner 32 | 9350 | 8500 | 4.500 |
| Example 33 | fluid dispersion 1 | surfactant 15 | surfactant 2 | 25:12 | 0.70 mass % | toner 33 | 1100 | 1000 | 0.052 |
| Example 34 | fluid dispersion 1 | surfactant 16 | surfactant 2 | 1:3 | 0.70 mass % | toner 34 | 1000 | 909 | 0.051 |
| Example 35 | fluid dispersion 1 | surfactant 17 | surfactant 2 | 5:21 | 0.70 mass % | toner 35 | 1030 | 936 | 0.051 |
| Example 36 | fluid dispersion 1 | surfactant 18 | surfactant 2 | 2:13 | 0.70 mass % | toner 36 | 900 | 818 | 0.051 |
| Example 37 | fluid dispersion 1 | surfactant 20 | — | only (1) | 0.70 mass % | toner 37 | 970 | 882 | 0.050 |
| Example 38 | fluid dispersion 1 | surfactant 21 | — | only (1) | 0.70 mass % | toner 38 | 1210 | 1100 | 0.050 |
| Example 39 | fluid dispersion 2 | surfactant 1 | surfactant 2 | 1:1 | 0.70 mass % | toner 39 | 1160 | 1055 | 0.053 |
| Example 40 | fluid dispersion 3 | surfactant 1 | surfactant 2 | 1:1 | 0.70 mass % | toner 40 | 1010 | 918 | 0.053 |

25

TABLE 4

| Examples | fogging (%) low temperature low humidity | ambient temperature ambient humidity | high temperature high humidity | image density (—) low temperature low humidity | ambient temperature ambient humidity | high temperature high humidity | development stripes (locations) low temperature low humidity | ambient temperature ambient humidity | high temperature high humidity | charging member contamination low temperature low humidity | ambient temperature ambient humidity | high temperature high humidity |
|---|---|---|---|---|---|---|---|---|---|---|---|---|
| Example 1 | 0.3 | 0.2 | 0.4 | 1.55 | 1.54 | 1.52 | 0 | 0 | 0 | A | A | A |
| Example 2 | 0.3 | 0.2 | 0.4 | 1.52 | 1.54 | 1.55 | 0 | 0 | 0 | A | A | A |
| Example 3 | 0.4 | 0.3 | 0.4 | 1.51 | 1.53 | 1.54 | 0 | 0 | 0 | A | A | A |
| Example 4 | 0.3 | 0.3 | 0.3 | 1.51 | 1.53 | 1.54 | 1 | 0 | 0 | A | A | A |
| Example 5 | 0.4 | 0.6 | 0.6 | 1.52 | 1.35 | 1.34 | 0 | 0 | 0 | B | B | A |
| Example 6 | 0.7 | 0.4 | 0.3 | 1.34 | 1.50 | 1.54 | 3 | 2 | 2 | A | A | A |
| Example 7 | 0.4 | 0.4 | 0.9 | 1.47 | 1.48 | 1.29 | 3 | 0 | 0 | B | A | A |
| Example 8 | 0.4 | 0.3 | 0.3 | 1.30 | 1.30 | 1.46 | 3 | 0 | 0 | A | A | A |
| Example 9 | 0.4 | 0.8 | 1.9 | 1.44 | 1.30 | 1.30 | 2 | 0 | 0 | B | B | A |
| Example 10 | 0.9 | 0.8 | 0.4 | 1.32 | 1.32 | 1.44 | 5 | 3 | 3 | A | A | A |
| Example 11 | 0.3 | 0.4 | 0.4 | 1.49 | 1.49 | 1.49 | 0 | 0 | 0 | A | A | A |
| Example 12 | 0.4 | 0.4 | 0.4 | 1.48 | 1.49 | 1.48 | 0 | 0 | 0 | A | A | A |
| Example 13 | 0.4 | 0.4 | 0.3 | 1.47 | 1.49 | 1.48 | 0 | 0 | 0 | A | A | A |
| Example 14 | 0.4 | 0.7 | 0.7 | 1.49 | 1.32 | 1.32 | 0 | 0 | 0 | B | B | A |
| Example 15 | 0.7 | 0.4 | 0.4 | 1.32 | 1.47 | 1.47 | 3 | 3 | 2 | A | A | A |
| Example 16 | 0.2 | 0.2 | 0.3 | 1.53 | 1.54 | 1.55 | 1 | 0 | 0 | A | A | A |
| Example 17 | 0.4 | 0.4 | 0.9 | 1.48 | 1.47 | 1.47 | 0 | 0 | 0 | A | A | B |
| Example 18 | 0.3 | 0.4 | 0.3 | 1.54 | 1.54 | 1.56 | 4 | 3 | 3 | A | A | A |
| Example 19 | 0.4 | 0.9 | 0.9 | 1.40 | 1.39 | 1.25 | 0 | 0 | 0 | B | B | B |
| Example 20 | 0.3 | 0.3 | 0.4 | 1.53 | 1.54 | 1.56 | 5 | 4 | 3 | A | A | A |
| Example 21 | 0.9 | 0.7 | 0.6 | 1.24 | 1.33 | 1.33 | 2 | 1 | 1 | A | A | B |
| Example 22 | 0.4 | 0.4 | 0.9 | 1.54 | 1.50 | 1.44 | 5 | 5 | 3 | A | A | A |
| Example 23 | 0.9 | 1.3 | 2.4 | 1.31 | 1.23 | 1.20 | 0 | 0 | 0 | C | B | C |
| Example 24 | 0.4 | 0.4 | 0.4 | 1.53 | 1.54 | 1.50 | 6 | 5 | 5 | A | A | A |
| Example 25 | 2.3 | 1.2 | 1.1 | 1.22 | 1.30 | 1.30 | 5 | 4 | 3 | B | B | B |
| Example 26 | 0.5 | 0.6 | 0.7 | 1.47 | 1.32 | 1.32 | 0 | 0 | 0 | B | B | A |
| Example 27 | 0.4 | 0.5 | 0.5 | 1.49 | 1.50 | 1.47 | 0 | 0 | 0 | A | A | A |
| Example 28 | 0.8 | 0.4 | 0.4 | 1.33 | 1.39 | 1.48 | 3 | 3 | 3 | A | A | A |
| Example 29 | 0.3 | 0.3 | 0.4 | 1.45 | 1.46 | 1.46 | 6 | 5 | 4 | A | A | A |
| Example 30 | 2.4 | 2.3 | 2.4 | 1.29 | 1.22 | 1.20 | 0 | 0 | 0 | B | B | B |
| Example 31 | 0.3 | 0.3 | 0.3 | 1.40 | 1.41 | 1.42 | 6 | 6 | 6 | A | A | A |
| Example 32 | 2.4 | 1.7 | 2.0 | 1.20 | 1.22 | 1.24 | 6 | 6 | 5 | A | B | B |
| Example 33 | 0.4 | 0.3 | 0.3 | 1.49 | 1.50 | 1.40 | 3 | 0 | 0 | B | B | B |
| Example 34 | 0.5 | 0.4 | 0.8 | 1.46 | 1.45 | 1.38 | 0 | 0 | 0 | A | A | A |
| Example 35 | 0.5 | 0.5 | 1.1 | 1.43 | 1.42 | 1.37 | 0 | 0 | 0 | B | B | B |
| Example 36 | 0.9 | 1.1 | 1.5 | 1.38 | 1.38 | 1.36 | 0 | 0 | 0 | B | B | B |
| Example 37 | 0.4 | 0.4 | 0.8 | 1.50 | 1.51 | 1.47 | 0 | 0 | 0 | B | B | B |

TABLE 4-continued

| | fogging (%) | | | image density (—) | | | development stripes (locations) | | | charging member contamination | | |
|---|---|---|---|---|---|---|---|---|---|---|---|---|
| Examples | low temperature low humidity | ambient temperature ambient humidity | high temperature high humidity | low temperature low humidity | ambient temperature ambient humidity | high temperature high humidity | low temperature low humidity | ambient temperature ambient humidity | high temperature high humidity | low temperature low humidity | ambient temperature ambient humidity | high temperature high humidity |
| Example 38 | 1.1 | 0.3 | 0.3 | 1.40 | 1.50 | 1.52 | 0 | 0 | 0 | A | A | A |
| Example 39 | 0.6 | 0.6 | 1.0 | 1.40 | 1.39 | 1.40 | 0 | 0 | 0 | A | A | B |
| Example 40 | 0.7 | 0.6 | 1.0 | 1.41 | 1.40 | 1.40 | 0 | 0 | 0 | A | A | A |

TABLE 5

| | | nonionic surfactant-containing wash water | | | | | toner properties | | |
|---|---|---|---|---|---|---|---|---|---|
| Comparative example | fluid toner particle dispersion | used surfactant (1) | used surfactant (2) | (1):(2) (molar ratio) | nonionic surfactant content in the wash water | toner no. | A (mg/g) | A/B | PO/EO |
| Comparative example 1 | fluid dispersion 1 | surfactant 14 | surfactant 2 | 25:2 | 7.00 mass % | comparative toner 1 | 9350 | 8500 | 0.004 |
| Comparative example 2 | fluid dispersion 1 | surfactant 14 | surfactant 19 | 1:55 | 7.00 mass % | comparative toner 2 | 9350 | 8500 | 5.522 |
| Comparative example 3 | fluid dispersion 1 | surfactant 14 | surfactant 2 | 4:1 | 0.05 mass % | comparative toner 3 | 80 | 73 | 0.020 |
| Comparative example 4 | fluid dispersion 1 | surfactant 14 | surfactant 2 | 4:1 | 7.60 mass % | comparative toner 4 | 11000 | 10000 | 0.020 |
| Comparative example 5 | fluid dispersion 1 | surfactant 14 | surfactant 6 | 1:21 | 0.05 mass % | comparative toner 5 | 80 | 73 | 4.500 |
| Comparative example 6 | fluid dispersion 1 | surfactant 14 | surfactant 6 | 1:21 | 7.65 mass % | comparative toner 6 | 11000 | 10000 | 4.500 |

TABLE 6

| | fogging (%) | | | image density (—) | | | development stripes (locations) | | | charging member contamination | | |
|---|---|---|---|---|---|---|---|---|---|---|---|---|
| Comparative example | low temperature low humidity | ambient temperature ambient humidity | high temperature high humidity | low temperature low humidity | ambient temperature ambient humidity | high temperature high humidity | low temperature low humidity | ambient temperature ambient humidity | high temperature high humidity | low temperature low humidity | ambient temperature ambient humidity | high temperature high humidity |
| Comparative example 1 | 2.4 | 3.5 | 4.2 | 1.21 | 1.15 | 1.11 | 0 | 0 | 0 | D | D | D |
| Comparative example 2 | 4.1 | 2.4 | 1.7 | 1.19 | 1.22 | 1.26 | 9 | 7 | 6 | A | A | B |
| Comparative example 3 | 0.3 | 0.3 | 0.3 | 1.45 | 1.47 | 1.47 | 11 | 9 | 9 | A | A | A |
| Comparative example 4 | 2.3 | 2.9 | 3.7 | 1.22 | 1.2 | 1.11 | 0 | 0 | 0 | D | D | D |
| Comparative example 5 | 0.3 | 0.3 | 0.3 | 1.43 | 1.43 | 1.45 | 12 | 10 | 9 | A | A | A |
| Comparative example 6 | 3.9 | 2.4 | 2.4 | 1.13 | 1.22 | 1.22 | 9 | 7 | 6 | B | B | C |

The invention claimed is:

1. A toner comprising a binder resin, a colorant, and a nonionic surfactant, wherein the nonionic surfactant has an oxyethylene group (EO) and an oxypropylene group (PO), and has a ratio of the number of moles of the oxypropylene group to the number of moles of the oxyethylene group (PO/EO) of at least 0.01 but not more than 5.00, and when A (μg/g) is defined as a nonionic surfactant content on the surface of the toner that can be extracted by methanol from 1 g of the toner, and B ($m^2$/g) is defined as a theoretical specific surface area determined from a toner particle diameter distribution obtained by a precision particle diameter distribution analyzer that operates based on an aperture electrical resistance method, a ratio (A/B) is at least 100 μg/$m^2$ but not more than 9000 μg/$m^2$.

2. The toner according to claim 1, wherein the nonionic surfactant comprises at least one polymer selected from the group consisting of polyoxyalkylene alkyl ethers, polyoxyalkylene alkyl esters, and polyethylene glycol-polypropylene glycol block copolymers.

* * * * *